US005123322A

United States Patent [19]

Hanzawa et al.

[11] Patent Number: 5,123,322

[45] Date of Patent: Jun. 23, 1992

[54] MUSICAL TONE GENERATING APPARATUS FOR ELECTRONIC MUSICAL INSTRUMENT

[75] Inventors: Kohtaro Hanzawa; Kunihiro Sugita; Hiroyuki Sasaki, all of Tokyo, Japan

[73] Assignee: Casio Computer Co., Ltd., Tokyo, Japan

[21] Appl. No.: 773,369

[22] Filed: Oct. 7, 1991

Related U.S. Application Data

[60] Division of Ser. No. 492,245, Mar. 9, 1990, which is a continuation of Ser. No. 118,448, Nov. 6, 1987, abandoned.

[30] Foreign Application Priority Data

| | | | |
|---|---|---|---|
| Nov. 10, 1986 | [JP] | Japan | 172304[U] |
| Dec. 9, 1986 | [JP] | Japan | 61-293650 |
| Jul. 6, 1987 | [JP] | Japan | 62-167069 |
| Jul. 6, 1987 | [JP] | Japan | 62-167070 |
| Jul. 6, 1987 | [JP] | Japan | 62-167071 |

[51] Int. Cl.[5] ..... G10H 7/00

[52] U.S. Cl. ..... 84/605; 84/604; 84/622; 84/625

[58] Field of Search ..... 84/600-602, 84/604-607, 622, 624, 625

[56] References Cited

U.S. PATENT DOCUMENTS

| | | |
|---|---|---|
| 4,128,032 | 12/1978 | Wada et al. . |
| 4,227,435 | 10/1980 | Ando et al. . |
| 4,305,319 | 12/1981 | Linn . |
| 4,383,462 | 5/1983 | Nagai . |
| 4,409,682 | 10/1983 | Mori . |
| 4,442,745 | 4/1984 | Gross et al. . |
| 4,461,199 | 7/1984 | Hiyoshi et al. . |
| 4,502,361 | 3/1985 | Vitanen et al. . |
| 4,520,708 | 6/1985 | Wachi . |
| 4,528,884 | 7/1985 | Kawamoto . |
| 4,539,884 | 9/1985 | Aoki . |
| 4,633,749 | 1/1987 | Fujimori et al. . |
| 4,635,520 | 1/1987 | Mitsumi . |
| 4,706,537 | 11/1987 | Oguri . |
| 4,713,996 | 12/1987 | Oguri . |
| 4,713,997 | 12/1987 | Deutsch . |
| 4,754,680 | 7/1988 | Morikawa . |

FOREIGN PATENT DOCUMENTS

| | | |
|---|---|---|
| 55-28072 | 2/1980 | Japan . |
| 55-166698 | 12/1980 | Japan . |
| 62-59994 | 3/1987 | Japan . |
| 62-106499 | 5/1987 | Japan . |

*Primary Examiner*—A. T. Grimley
*Assistant Examiner*—Matthew S. Smith
*Attorney, Agent, or Firm*—Frishauf, Holtz, Goodman & Woodward

[57] ABSTRACT

The position of a connecting portion between waveforms can be arbitrarily set when a plurality of waveform data is obtained by changing pitch widths of stored external sound waveform data, when a read rate of the waveform data is increased or decreased and the readout waveform data is synthesized, or when the waveform is changed from one waveform to another waveform. In addition, a plurality of loop reproduction cycles can be arbitrarily set when the waveform data is to be read out. In loop reproduction, two items of waveform data having different phases between the preset start and end addresses can be repeatedly read out and synthesized, and their mixing ratios can be changed as a function of time, thereby performing loop reproduction so as not to abruptly change amplitude values of the waveforms.

11 Claims, 21 Drawing Sheets

MUSICAL TONE GENERATING APPARATUS FOR ELECTRONIC MUSICAL INSTRUMENT

This is a division of application Ser. No. 07/492,245 filed Mar. 9, 1990 which is a continuation of application Ser. No. 07/118,448 filed Nov. 6, 1987 (now abandoned).

BACKGROUND OF THE INVENTION

The present invention relates to a musical tone generating apparatus for an electronic musical instrument, wherein a musical tone is generated and produced on the basis of waveform information obtained by collecting and storing external sounds.

A conventional electronic musical instrument records external sounds with a microphone, samples these sounds at a predetermined period, and storing obtained waveform levels in a RAM (Random Access Memory). In order to produce a musical tone on the basis of such waveform information stored in the RAM, a plurality of waveforms stored in the RAM can be synthesized to produce a synthesized or composite waveform. In this case, when different waveforms are simply synthesized, clear composite musical tones cannot be obtained because tone pitches of the waveforms are different, the waveforms do not have a predetermined mixing ratio, or the lengths of time required for producing a tone in the waveforms are different from each other.

When such a synthesis is to be performed, leading edges of the waveforms of the external sounds are normally different from each other. Simple synthesis cannot provide a clear synthesized or composite tone, and the resultant tone cannot be used as a musical tone at all.

Another conventional electronic musical instrument reproduces a musical tone by repeatedly reading out a waveform information, i.e., by performing loop reproduction, as described in Japanese Patent Disclosure (Kokai) No. 55-28072 and U.S. Pat. Nos. 4,442,745 and 4,502,361.

In a conventional electronic musical instrument of the loop reproduction type described above, a loop interval to be specified is fixed, or the loop interval is preset by the manufacturer. For this reason, the waveform memory cannot be effectively utilized. In order to obtain a variety of sound source waveforms, another sampling waveform is undesirably required.

When loop reproduction is performed in a conventional electronic musical instrument, start address data of the loop reproduction interval, that is, loop start address data, and the end address data of the loop reproduction interval, that is, loop end address data must be preset. When reproduction address data, i.e., current address data, reaches the loop end address, loop start address data must be written in a current address register.

However, according to the above scheme, when the current address data is updated to the loop start address data near the loop end address, a smooth waveform cannot be often obtained and the resultant tone is not smoothly reproduced. In addition, click noise corresponding to the repetition interval of the loop reproduction interval is undesirably mixed in the reproduced tone.

SUMMARY OF THE INVENTION

It is an object of the present invention to provide a musical tone generating apparatus for an electronic musical instrument, wherein a clear synthesized tone which can be utilized as a musical tone can be produced by synthesis of waveform data of a plurality of external tones.

It is another object of the present invention to provide a musical tone generating apparatus for an electronic musical instrument, wherein loop reproduction of one waveform can be performed every predetermined interval, thereby obtaining a variety of sound source waveforms from one waveform.

It is still another object of the present invention to provide a waveform generating apparatus for an electronic musical instrument, wherein click noise can be eliminated from loop reproduction, and loop reproduction can be performed without abruptly changing the amplitude values.

According to one aspect of this invention, there is provided a musical tone generating apparatus for an electronic musical instrument comprising sound collecting means for collecting external sounds, storage means for storing waveform data of the collected external sounds, means for reading out waveform data stored in the storage means, and musical tone generating/producing means for generating and producing a musical tone corresponding to the waveform data read out by the reading means, comprising:

- readout means for reading waveform data of the plurality of external sounds stored in the storage means;
- synthesizing means for synthesizing waveform data of the plurality of external sounds by controlling the readout means; and
- memory means for storing synthesized waveform data obtained by the synthesizing means.

According to another aspect of this invention, there is provided a waveform generating apparatus for an electronic musical instrument, comprising:

- waveform information storage means for storing musical tone waveform information as a series of waveform data;
- data interval setting means for selecting a plurality of data intervals from the series of waveform data stored in the waveform information storage means, and for setting start and end address data of each of the plurality of data intervals and a read sequence thereof; and
- reading means for reading out the waveform data from the waveform information storage means on the basis of the read sequence set by the data interval setting means.

According to still another aspect of this invention, there is provided a waveform generating apparatus for an electronic musical instrument, comprising:

- waveform information storage means for storing musical tone waveform information;
- reading means for repeatedly reading out first and second waveform data having different phases in a given reproduction interval from the waveform information storage means;
- crossfade signal generating means for generating a crossfade signal in the given interval so as to change a mixing ratio of the first and second readout waveform data as a function of time; and
- synthesizing means for correcting the first and second waveform data with the crossfade signal and synthesizing the corrected first and second waveform data.

DETAILED DESCRIPTION OF THE PREFERRED EMBODIMENTS

Preferred embodiments of the present invention will be described in detail with reference to the accompanying drawings.

Figure 1:
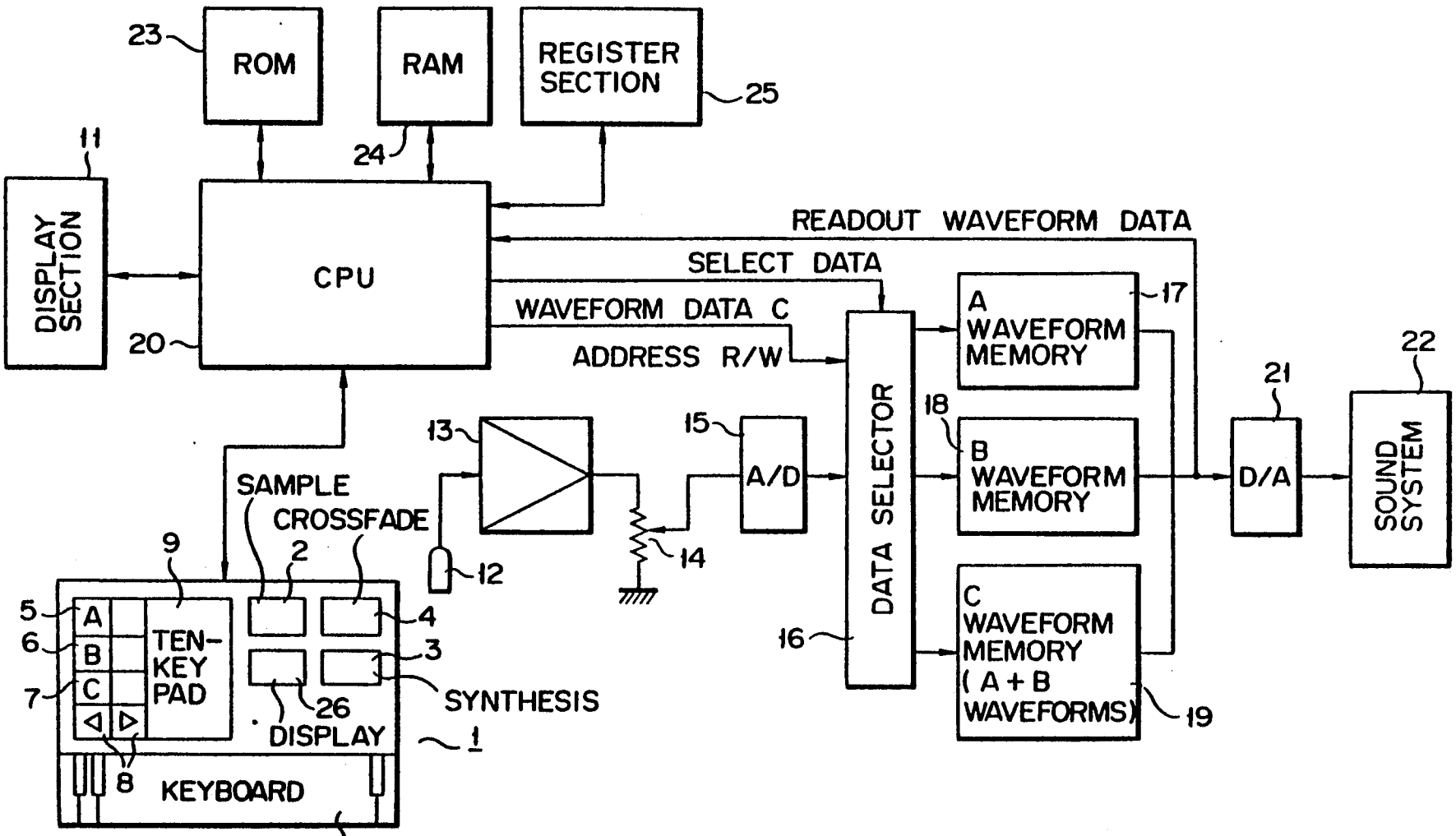
FIG. 1 is a block diagram of an electronic musical instrument according to the present invention corresponding to first and second embodiments.

FIG. 1 is a block diagram of an electronic musical instrument of the present invention corresponding to first and second embodiments. Reference numeral 1 denotes a key input section. Input section 1 includes sampling key 2, synthesis key 3, crossfade key 4, A key 5, B key 6, C key 7, cursor shift keys 8, ten-key pad 9, display key 26, and keyboard 10.

Sampling key 2 is used to record external sounds.

Synthesis key 3 is used to synthesize waveforms A and B collected and stored on the basis of waveform data of two external sounds and to obtain synthesized waveform C.

Crossfade key 4 changes an increase/decrease in mixing ratio of waveforms A and B during read access of waveforms A and B, thereby obtaining synthesized waveform C.

A, B, and C keys 5, 6, and 7 are used to specify waveforms A, B, and C, respectively, and are used to record the waveforms of the corresponding external sounds, read out the stored waveforms, display waveforms A, B, and C, and specify frequencies of read clocks for waveforms A, B, and C.

Cursor shift keys 8 are used to move a vertical line cursor to the right and left on display section 11 and to specify a leading edge of the waveform displayed on display section 11.

Ten-key pad 9 is used together with A and B keys 5 and 6 to input read pitch width data for waveforms A and B.

Display key 26 is operated together with A, B, and C keys 5, 6, and 7 to read out waveform data A, B, and C from A, B, and C waveform memories 17, 18, and 19. Each readout waveform data is displayed on display section 11.

A tone color of a musical tone which is specified at keyboard 10 corresponds to one of the waveforms which is specified by A, B, or C key 5, 6, or 7.

The waveform signal of the external sound collected and input from microphone 12 is amplified by amplifier 13, and the level of the amplified signal is set to an optimal level by sound level volume control 14. Waveform data is then stored in A or B waveform memory 17 or 18 through A/D converter 15 and data selector 16 every sampling period. The sampling period is determined by write address data and write instruction signal W from CPU 20 which is incremented in response to predetermined clock signal $\phi$.

External sound waveform data A and B stored in A and B waveform memories 17 and 18 are synthesized by CPU 20, and the synthesized waveform data is stored in C waveform memory 19 through data selector 16.

Data selector 16 is operated to open a path for a bus line to A, B, or C waveform memory 17, 18, or 19. The contents of the selected data are determined by operations of A, B, or C key 5, 6, or 7 in key input section 1.

Waveform data A, B, and C stored in A, B, and C waveform memories 17, 18, and 19 is read out by read address data and read instruction signal R supplied from CPU 20 through data selector 16 The readout data is produced as a musical tone from sound system 22 through D/A converter 21.

Programs for causing the CPU 20 to perform various operations are stored in ROM 23. The data processed by CPU 20 is stored in RAM 24.

Figure 2:
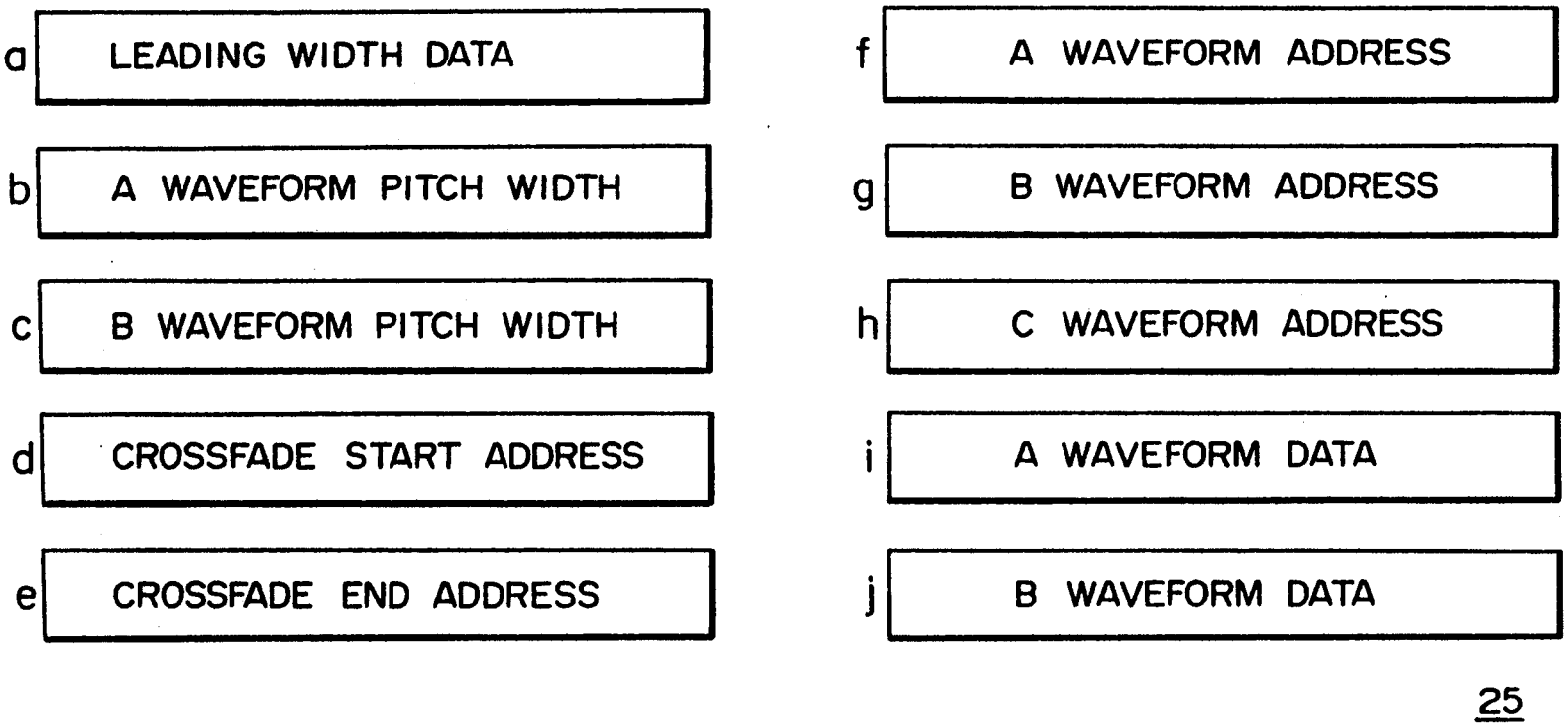
FIG. 2 is a view showing register section 25.

Register section 25 is used to synthesize waveforms A and B to obtain synthesized waveform C. As shown in FIG. 2, register section 25 comprises registers a, b, c, d, e, f, g, h, i, and j. Corresponding data is stored in registers a to j.

GENERAL OPERATIONS OF FIRST AND SECOND EMBODIMENTS

Figure 3:
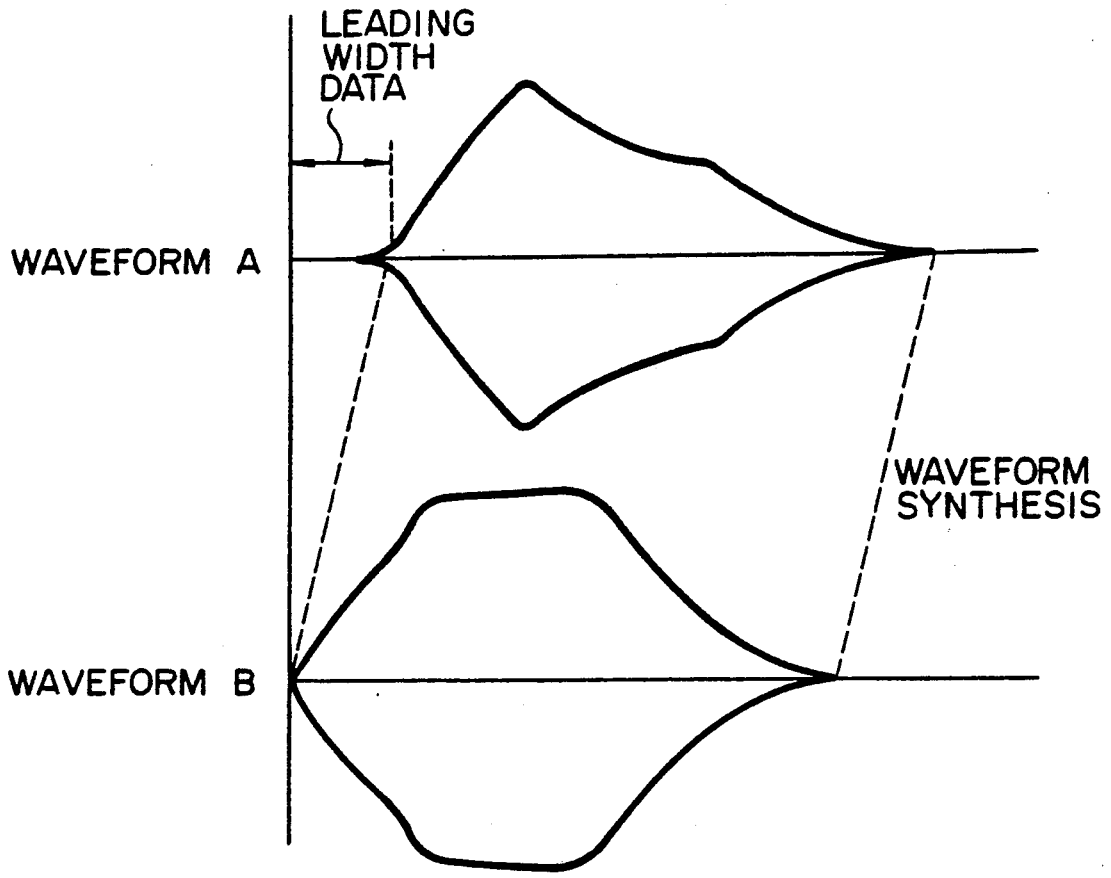
FIG. 3 is a chart showing one example of external sound input waveforms.

Assume that waveforms A and B obtained by external sound collection with microphone 12 and sampling key 2 are respectively stored in A and B waveform memories 17 and 18, as shown in FIG. 3. Waveform A has a large leading width from the start of storage to the leading edge of the waveform.

In order to set leading width data of waveform A, A key 5 and display key 26 are operated to display waveform A on display section 11. Cursor shift keys 8 are used to shift the cursor to the leading edge of the waveform. CPU 20 sets address data for the address of A waveform memory 17 as pitch width data in register a in register section 25 on the basis of the coordinate data designated by the cursor.

In order to set read pitch width data for waveforms A and B, pitch width data representing ratios of durations of the leading to trailing edges of waveforms A and B, or a pitch width ratio of one waveform is input with ten-key pad 9 and A o B key 5 or 6. One ratio is set to be 1.0 while the other ratio is set to be a value (e.g., 1.2) except for 1.0. CPU 20 sets these pitch width data in registers b and c in register section 25.

Pitch width data of 1.0 is read out at the same pitch as that of the original waveform. However, when the value of the pitch width data is more than 1.0, the read speed is increased. However, when the value of the pitch width data is less than 1.0, the read speed is decreased. The pitch width data in registers b and c is sequentially added to the values in registers f and q during read access of waveforms A and B. In this case, the decimal parts of the sums are rounded off, and only integral parts are supplied as read address data to A and B waveform memories 17 and 18. Waveform data read out from A and B waveform memories 17 and 18 is set in registers i and j, respectively.

OPERATION OF WAVEFORM SYNTHESIS (FIRST EMBODIMENT)

Figure 5:
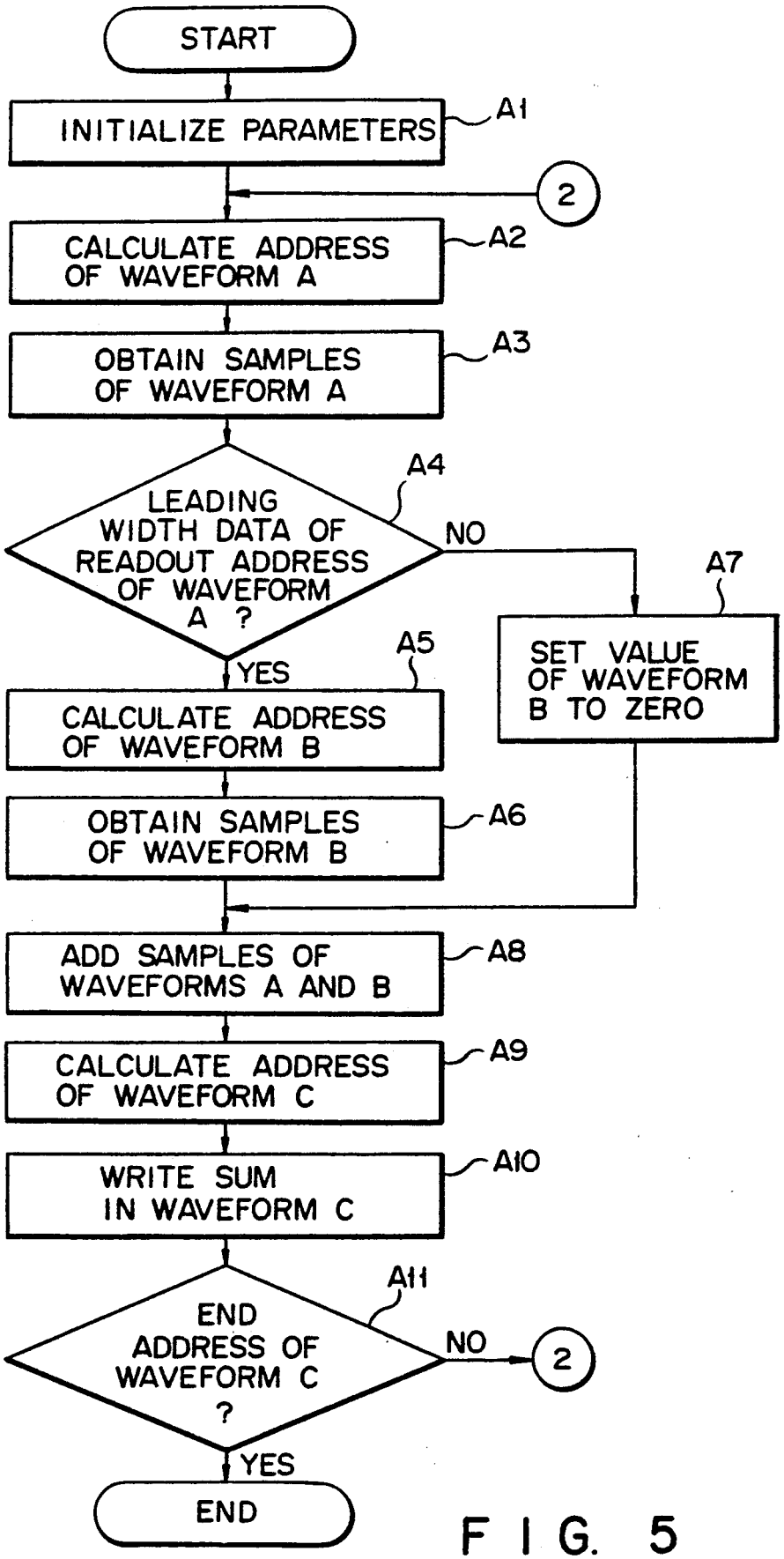
FIG. 5 is a flow chart for explaining waveform synthesis processing.

When synthesis key 3 is operated, CPU 20 starts processing shown in FIG. 5. CPU 20 performs initialization, i.e., clearing of registers f to j in step A1. In step A2, CPU 20 calculates read address data of waveform A such that pitch width data of waveform A stored in register b is accumulated in register f serving as an address counter of waveform A. The count of register f is set to be "0" immediately after initialization. In step A3, CPU 20 reads out waveform data A from a memory area at the start address of A waveform memory 17. The readout waveform data A is set in register i. The data at the start address of A waveform memory 17 represents a portion prior to the leading edge of the waveform, so that waveform data A of "0" is set in register i.

CPU 20 determines in step A4 whether the value of the read address data of waveform A reaches that of the leading width data. Since the read address data represents "0" and does not reach the value of the leading width data, the CPU 20 advances to step A7 and updates waveform data B in register j to be "0".

Thereafter, CPU 20 adds and synthesizes waveform data A and B stored in registers i and j in step A8. CPU 20 then calculates write address data for waveform C in step A9. The write address data for waveform C is normally incremented one by one and is set to be "0" immediately after initialization. On the basis of this data "0", CPU 20 writes the added/synthesized waveform data C at the start address of C waveform memory 19.

If CPU 20 determines in step A11 that the write address of C waveform memory 19 is not the end address, the flow returns to step A2, and the above operations are repeated. The data value of waveform B is kept zero until the read address data of waveform A is not equal to the leading width data in steps A4 and A7. Read access of the leading edge of waveform A is matched with that of waveform B.

As is apparent from the above description, waveform synthesis can be performed by matching the leading edges of waveforms A and B to be synthesized, thereby obtaining a clear synthesized tone.

When the read address data for waveform A coincides with the leading width data, the CPU 20 advances to steps A5 and A6 and initiates read access of waveform B in the same manner as in steps A2 and A3. CPU 20 then initiates synthesis and write access of waveform C in steps A8 to A11. Meanwhile, the pitch width data of the read address data (steps A2 and A5) of waveforms A and B is matched with the data values for matching the pitch widths of waveforms A and B.

In this manner, waveforms A and B to be synthesized can be added while their pitch widths match with each other, thereby obtaining a clear synthesized tone.

If a leading width is present in waveform B in place of waveform A, the leading width data set by cursor shift keys 8 is set to be a negative value. CPU 20 determines whether this value is actually a negative value. If so, an absolute value of the leading width data is added to the read address data for waveform B in register g. This processing is performed immediately after initialization of step A1. In this case, the leading width is absent from synthesized waveform C.

If leading widths are present in both waveforms A and B, leading width data of waveforms A and B is input with cursor shift keys 8 so as to set {(leading width data of waveform A)−(leading width data of waveform B)} as leading width data in register a.

OPERATION OF CROSSFADE SYNTHESIS (SECOND EMBODIMENT)

The start and end address data of a crossfade interval for crossfade synthesis is stored in registers d and e, respectively. However, the start and end address data of the crossfade interval may be specified with cursor shift keys 8 and crossfade key 4 for the waveform displayed on display section 11.

Figure 6:
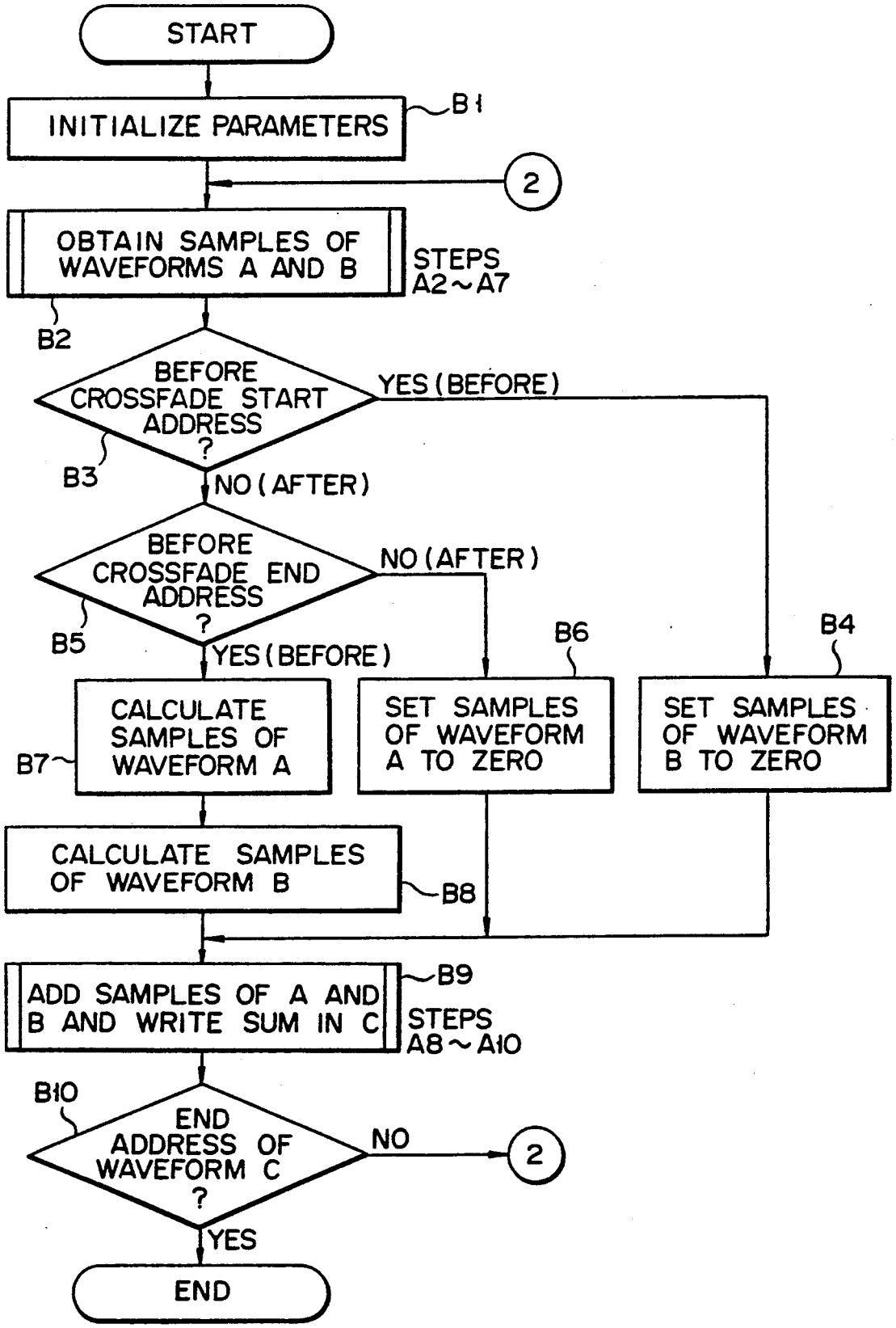
FIG. 6 is a flow chart for explaining crossfade synthesis processing.

In order to perform crossfade synthesis, the crossfade key 4 in key input section 1 is operated to cause CPU 20 to perform processing shown in FIG. 6. More specifically, in step B1, CPU 20 performs initialization, i.e., clearing of registers f to j. CPU 20 reads out waveforms A and B in step B2 in the same manner as in steps A2 to A7.

Figure 4:
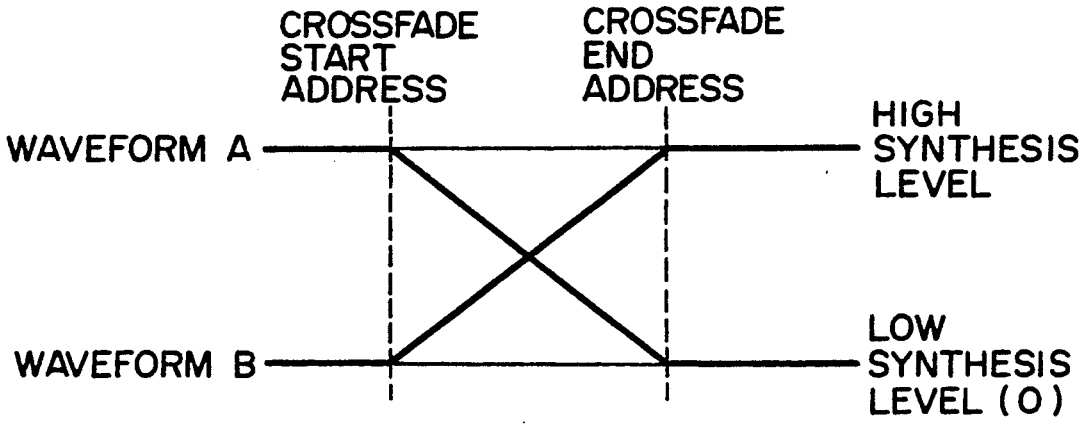
FIG. 4 is a chart showing a mixing ratio level in crossfade synthesis.

If time does not reach the crossfade interval (step B3), CPU 20 sets the level of waveform B to be "0" (step B4), as shown in FIG. 4. However, if time is after the crossfade interval (steps B3 and B5), the level of waveform A is set to be "0" (step B6), as shown in FIG. 4. If time falls within the crossfade interval (steps B3 and B5), the levels of waveforms A and B read out in step B2 are calculated in accordance with level synthesis ratios as follows (steps B7 and B8):

(Calculated Waveform Value A) = (Readout Waveform Value A) × [{1.0 − (Read Address Value of Waveform C) − (Crossfade Start Address Value)}/{(Crossfade End Address Value) − (Crossfade Start Address Value)}]

(Calculated Waveform Value B) = (Readout Waveform Value B) × {(Read Address Value of Waveform C) − (Crossfade Start Address Value)}/{(Crossfade End Address Value) − (Crossfade Start Address Value)}

Waveform data A and B calculated according to the synthesis ratios in steps B3 and B8 is added and synthesized in step B9 and synthesized waveform data C is written in C waveform memory 19 in the same manner as in steps A8 to A10. The operations in steps B2 and B9 continue until the write address of C waveform memory 19 reaches the end address (step B10).

Therefore, the synthesized tones can be obtained while the synthesizing ratios of waveform data A and B of the external sounds are sequentially changed.

The number of waveforms to be synthesized may be three or more. The present invention is not limited to the particular embodiments described above.

Figure 7:
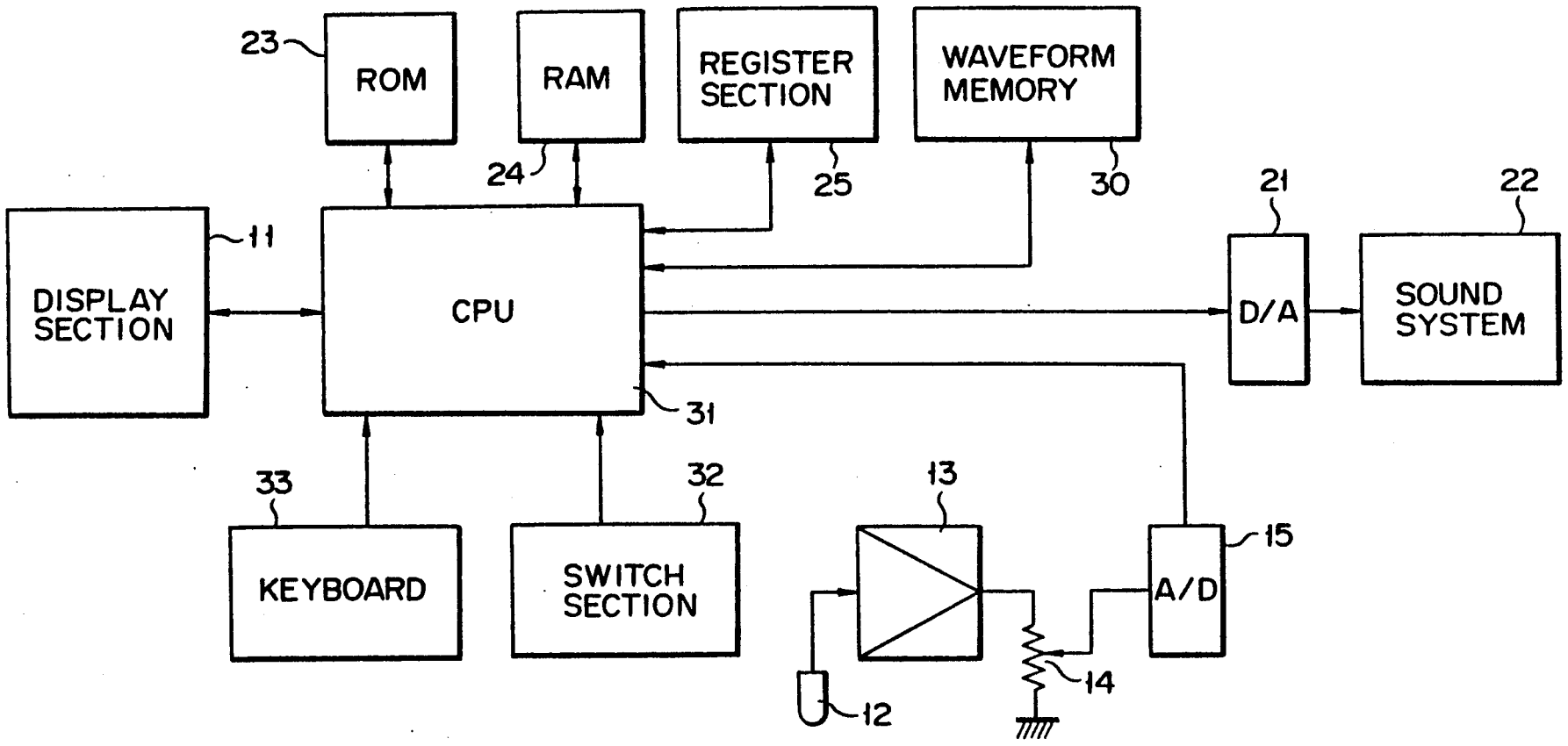
FIG. 7 is a block diagram of an electronic musical instrument corresponding to third and fourth embodiments.

FIG. 7 is a block diagram of an electronic musical instrument employing the present invention and corresponding to third and fourth embodiments of the present invention. The third embodiment exemplifies an operation wherein an address width for crossing waveforms A and B in crossfade synthesis (FIGS. 4 and 6) of waveforms A and B in the second embodiment can be variably set. The fourth embodiment exemplifies an operation wherein waveform B is delayed. As shown in (A), (B), and (C) in FIG. 17, waveforms 1 and 2 (corresponding to waveforms A and B in FIG. 4) are crossfade-synthesized to obtain a synthesized waveform by arbitrarily setting address data of crossfade start point P1 and crossfade end point P2 in the third embodiment. As shown in (A) in FIG. 18, in the fourth embodiment, delay time can be arbitrarily set to delay the leading edge of waveform 2. The basic operation of the circuit shown in FIG. 7 is substantially the same as that of FIG. 1, and the same reference numerals as in FIG. 1 denote the same parts in FIG. 7. A, B, and C waveform memories 17, 18, and 19 in FIG. 1 are combined as waveform memory 30. Data selector 16 in FIG. 1 is included in CPU 31. Key input section 1 and keyboard 10 in FIG. 1 are separately arranged as switch section 32 and keyboard 33. Register section 25 includes all registers to be used in the operation to be described later.

Figure 8:
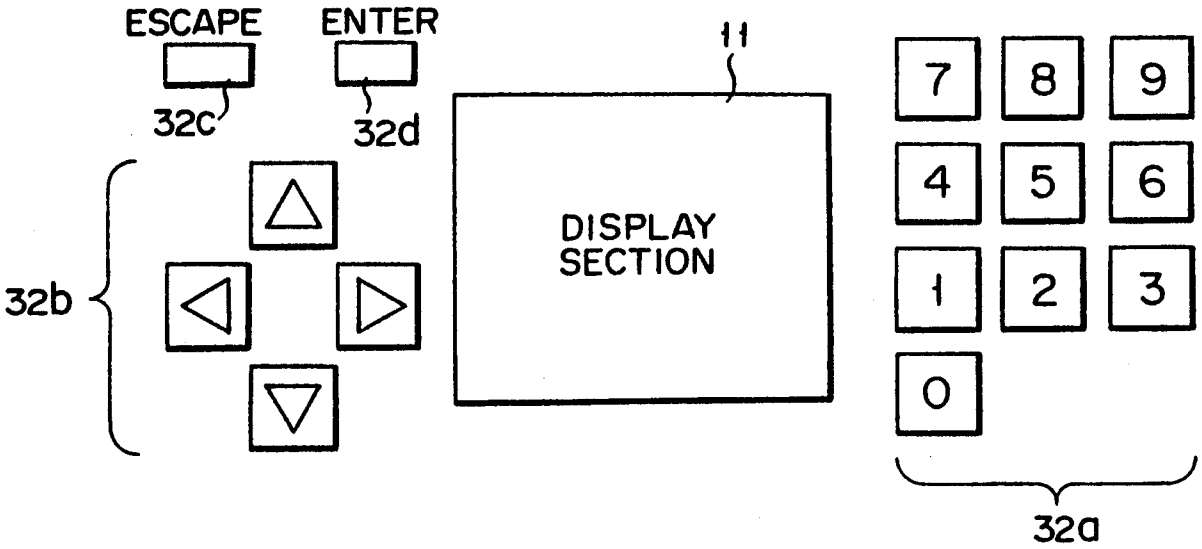
FIG. 8 is a schematic view of a panel surface.

FIG. 8 shows the layout of the operation panel surface. Display section 11 is arranged at the center of the operation panel surface. Ten-key pad 32*a* for entering numeric data in switch section 32 is arranged to the right of display section 11. Four cursor shift keys 32*b*, escape key 32*c*, and enter key 32*d* are arranged to the left of display section 11. Four cursor shift keys 32*b* are used to shift mode designation arrow 11*a* (FIG. 9) displayed on display section 11 and cursor 11*b* (FIG. 10) displayed on display section 11 in any one of the upper, lower, right, and left directions. Escape key 32*c* is used to display the immediately preceding mode. Enter key 32*d* is used to confirm the type of displayed mode and the input numeric value.

OPERATIONS OF THIRD AND FOURTH EMBODIMENTS

The procedures for setting various parameters for performing crossfade synthesis of waveforms 1 and 2 shown in FIGS. 17(A) to 17(C) and 18(A) to 18(C) by using display section 11 and switch section 32 will be described mainly with reference to FIGS. 8 to 14.

Figure 9:
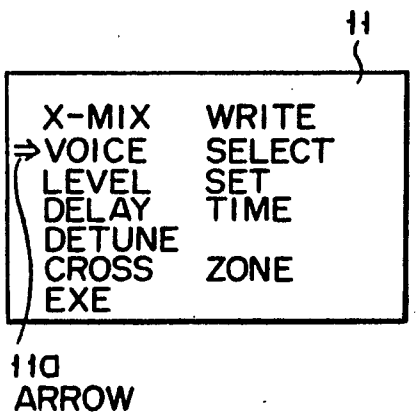
FIGS. 9 to 15 are views showing various menu display contents.

FIG. 9 shows the display contents of the main menu wherein a cross-mix write (X-MIX WRITE) mode is displayed with predetermined operations. The player sets arrow 11*a* to the voice select position (VOICE SELECT) for tone color selection with cursor shift keys 32*b* and depresses enter key 32*d*, thereby designating the type of cross-mix write mode.

Figure 10:
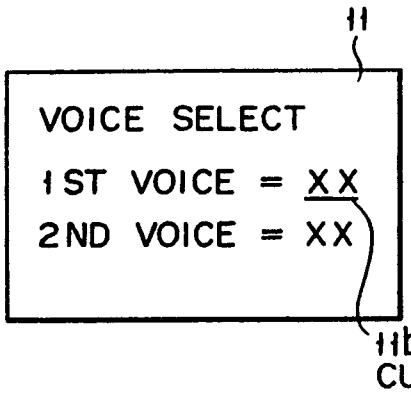

As shown in FIG. 10, the display section 11 then displays the tone color select menu. The player operates cursor shift keys 32*b* to set cursor 11*b* to the first voice position (1ST VOICE) and enters with ten-key pad 32*a* a value corresponding to a desired tone color. The player depresses enter key 32*d*. The player then shifts cursor 11*b* to the second voice position (2ND VOICE) and enters a number with ten-key pad 32*a*. Finally, the player depresses enter key 32*d*, thereby determining the contents of waveforms 1 and 2 for crossfade synthesis. When the player depresses escape key 32*c*, the previous display contents shown in FIG. 9 are displayed on display section 11. The player sets arrow 11*a* to level set position (LEVEL SET) and depresses enter key 32*d*.

Figure 11:
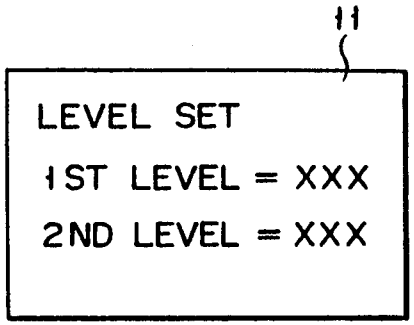

The tone color level setting menu shown in FIG. 11 is displayed on display section 11. In the same manner as described above, the player designates the position of cursor 11*b* with cursor shift keys 32*b*, enters a numeric value with ten-key pad 32*a*, and depresses enter key 32*d*, thereby setting the levels of waveforms 1 and 2. These levels are determined relative to each other in consideration of a crossfade-synthesized waveform.

Figure 12:
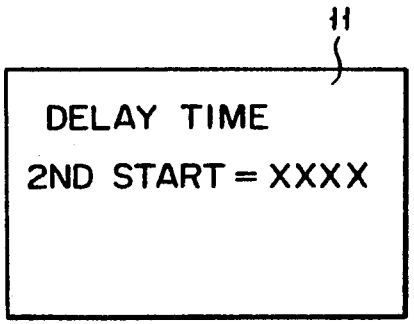
Figure 13:
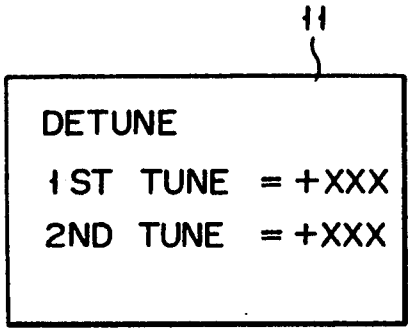
Figure 14:
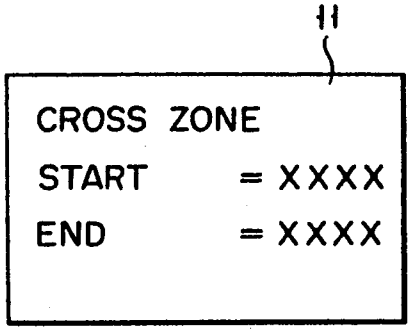
Figure 15:
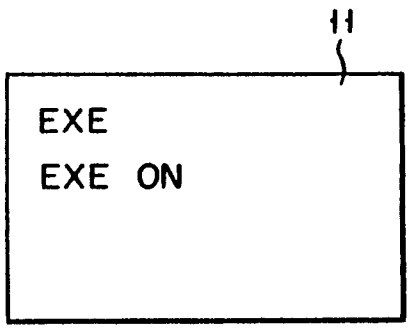

The display contents of display section 11 are changed into delay time processing (DELAY TIME) in FIG. 12, detune processing (DETUNE) in FIG. 13, crossfade zone processing (CROSS ZONE) in FIG. 14, and execution (EXE) in FIG. 15 in the same operations as described above.

FIG. 12 shows menu contents for setting the position of the second tone color waveform. More specifically, this menu is used to determine the start position of waveform 2 in waveform 1, which corresponds to a delay time in FIG. 18(B). In other words, the end address data for waveform 1 is determined.

FIG. 13 shows the contents of the tone color tuning setting menu so as to set differences between the pitches of the original waveform and waveform 1 and between the pitches of the original waveform and waveform 2, that is, frequencies of waveforms 1 and 2 (1ST TUNE and 2ND TUNE).

FIG. 14 shows the contents of the cross-mix position setting menu to determine the position (i.e., START) where the waveform 2 crosses waveform 1 and the position (i.e., END) where the waveform 2 does not cross waveform 1 any longer.

In this manner, parameters for waveforms 1 and 2 are determined.

FIG. 15 shows the operation following parameter setting of FIGS. 9 to 14 and indicates the operation start menu. The player operates upper and lower cursor shift keys 32*b* to alternately indicate the ON and OFF state. In the ON state, the program is executed upon depression of enter key 32*d*.

Figure 16A:
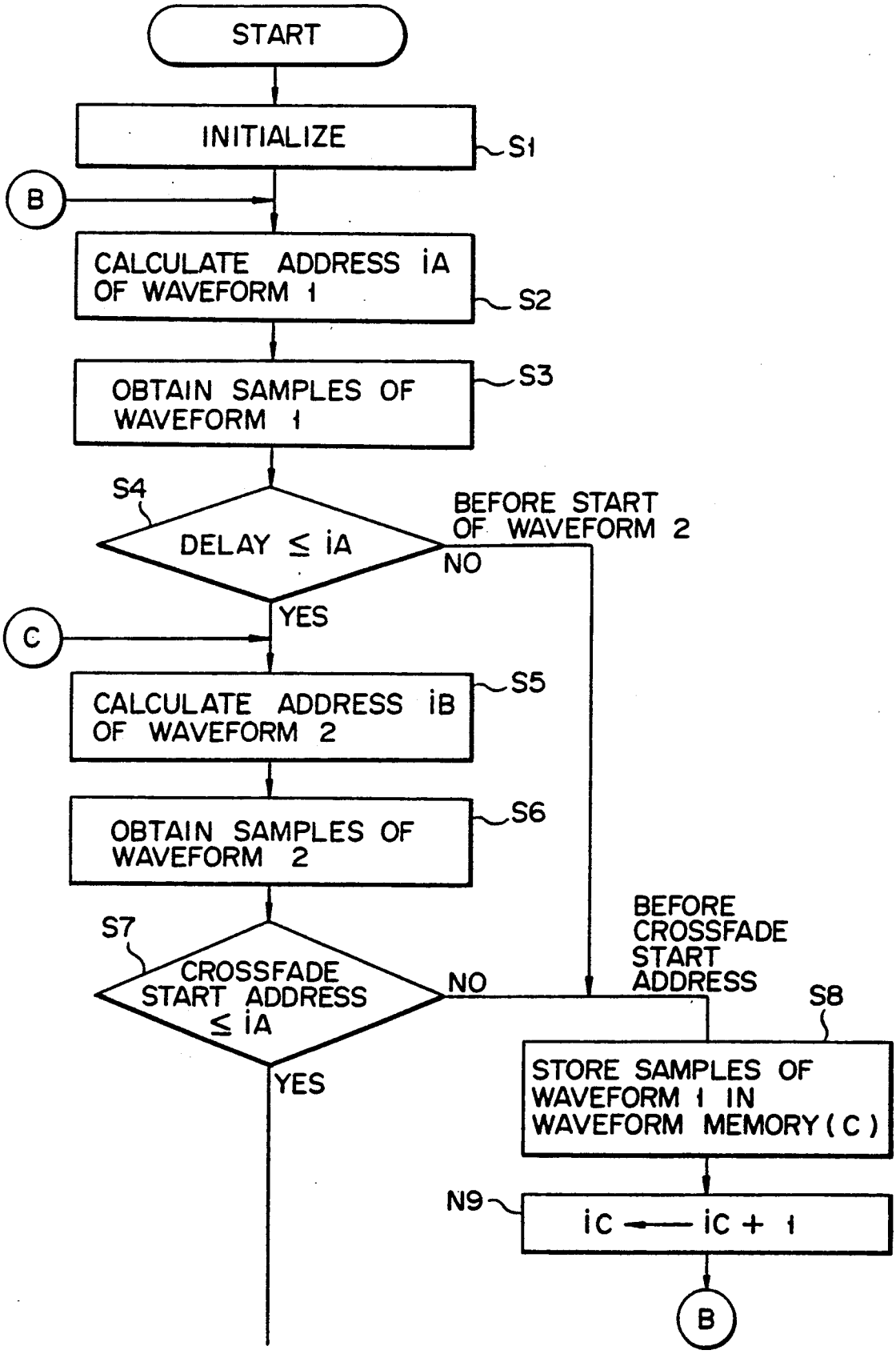
FIGS. 16A and 16B show a flow chart for explaining the operations of the third and fourth embodiments.
Figure 16B:
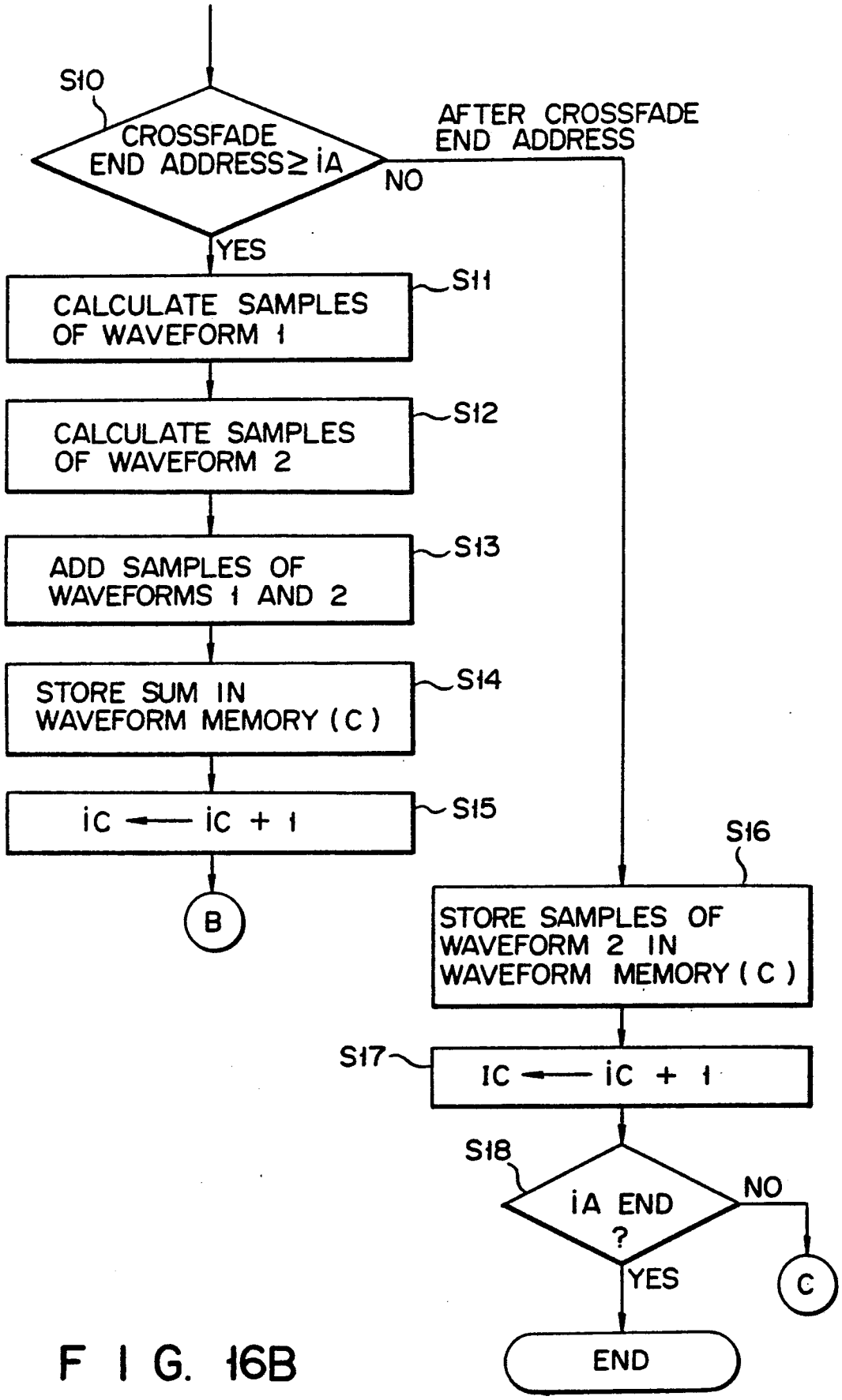

FIGS. 16A and 16B show a flow of operations in the third and fourth embodiments. This program is initiated upon depression of enter key 32*d* in the EXE ON state of FIG. 15. CPU 31 performs initialization in step S1 and calculates a value obtained in consideration of a detune value ("detune=0" indicates a read interval corresponding to the fundamental frequency) to address data iA of waveform 1 in step S2. CPU 31 samples waveform 1 on the basis of the calculated address data in step S3. CPU 31 determines in step S4 whether the delay time (FIG. 12) has elapsed, i.e., whether the currently calculated address data iA represents time falling within the delay time in FIG. 18(B).

THIRD EMBODIMENT

In the third embodiment, the start time of waveform 1 is the same as that of waveform 2. Step S4 as the decision step is determined to be YES. CPU 31 calculates a value obtained by in consideration of a detune value for address data iB of waveform 2 (step S5). Waveform 2 is sampled on the basis of the calculated address data (step S6). CPU 31 then determines in step S7 whether address data iA of waveform 1 represents a value smaller than that of crossfade start point (point P1 in FIG. 17(C)).

Since the value represented by address data iA is smaller than that represented by crossfade start point P1, step S7 is determined to be NO. The sample of waveform 1 is stored in synthesized waveform memory (C) (step S8). Address data iC is incremented by one, and the address of waveform memory (C) is incremented by one (step S9). If step S7 is determined to be NO, the operations in steps S2 to S9 are repeated.

If YES in step S7, CPU 31 determines in step S10 whether address data iA represents a value smaller than a value corresponding to the crossfade end point (i.e., point P2 in FIG. 17(C)). If YES in step S10, operations for waveforms 1 and 2 in consideration of their levels are performed (steps S11 and S12). More specifically, in step S11, the amplitude of waveform 1 at the crossfade start point is set to be 1 and that at the crossfade end point is set to be zero. In step S12, the amplitude of waveform 2 at the crossfade start point is set to be zero and that at the crossfade end point is set to be 1.

The samples of waveforms 1 and 2 are added to each other in step S13, and the added or synthesized waveform is stored in waveform memory (C) (step S14). Address data iC is incremented by one to increment the address of waveform memory (C) (step S15). If YES in step S10, the operations in steps S2 to S7 and steps S10 to S15 are repeated.

Thereafter, if NO in step S10, the address data represents a value larger than that of crossfade end point P2. In this case, CPU 31 stores or sets the sample of waveform 2 in waveform memory (C) in step S16. Address data iC is incremented by one (step S17) and CPU 31 determines in step S18 whether address data iA represents an end address.

If NO in step S18, waveform 2 still continues. The operations in steps S5 to S7, S10, and S16 to S18 are repeated. If YES in step S18, the flow is ended.

Figure 17:
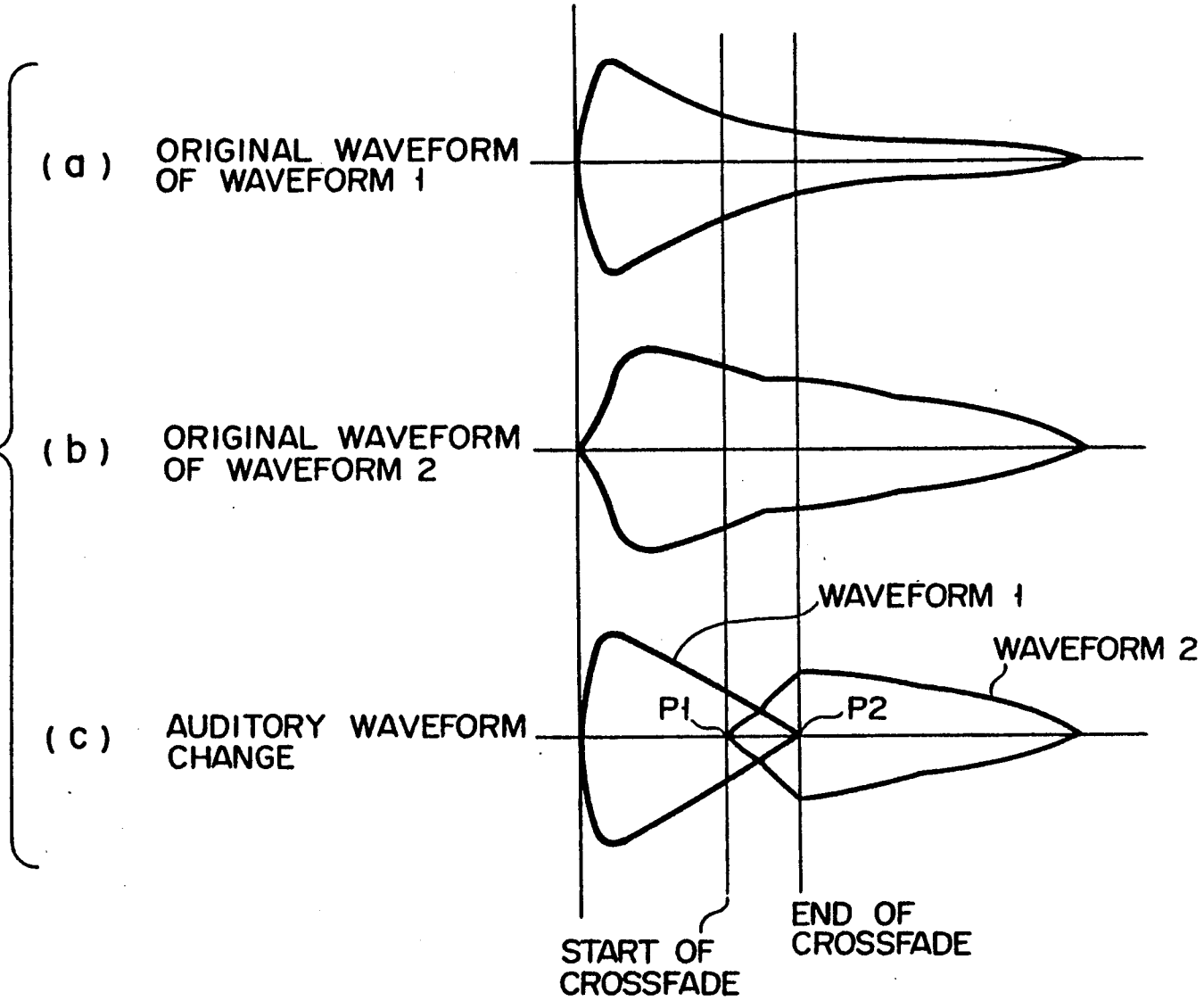
FIG. 17 shows charts of waveforms when a delay time is zero.

FIG. 17 shows waveforms of crossfade synthesis when the delay time is zero, i.e., the operation of the third embodiment is performed. The synthesized waveform between crossfade start and end points Pl and P2 is a sum of a decreasing portion of waveform 1 and an increasing portion of waveform 2.

OPERATION OF FOURTH EMBODIMENT

The fourth embodiment can set a desired delay time of waveform 2, as described with reference to (B) in FIG. 18(B). That is, the delay time set in FIG. 12 is not zero.

In this case, since NO in step S4, CPU 31 sets the sample of waveform 1 in waveform memory (C) in step S8. Address data iC is incremented by one (step S9). Until the delay time has elapsed, the operations for only waveform 1 in steps S2 to S4, S8, and S9 are repeated.

When the delay time has elapsed and YES in step S4, the same operations as in the third embodiment are performed.

Figure 18:
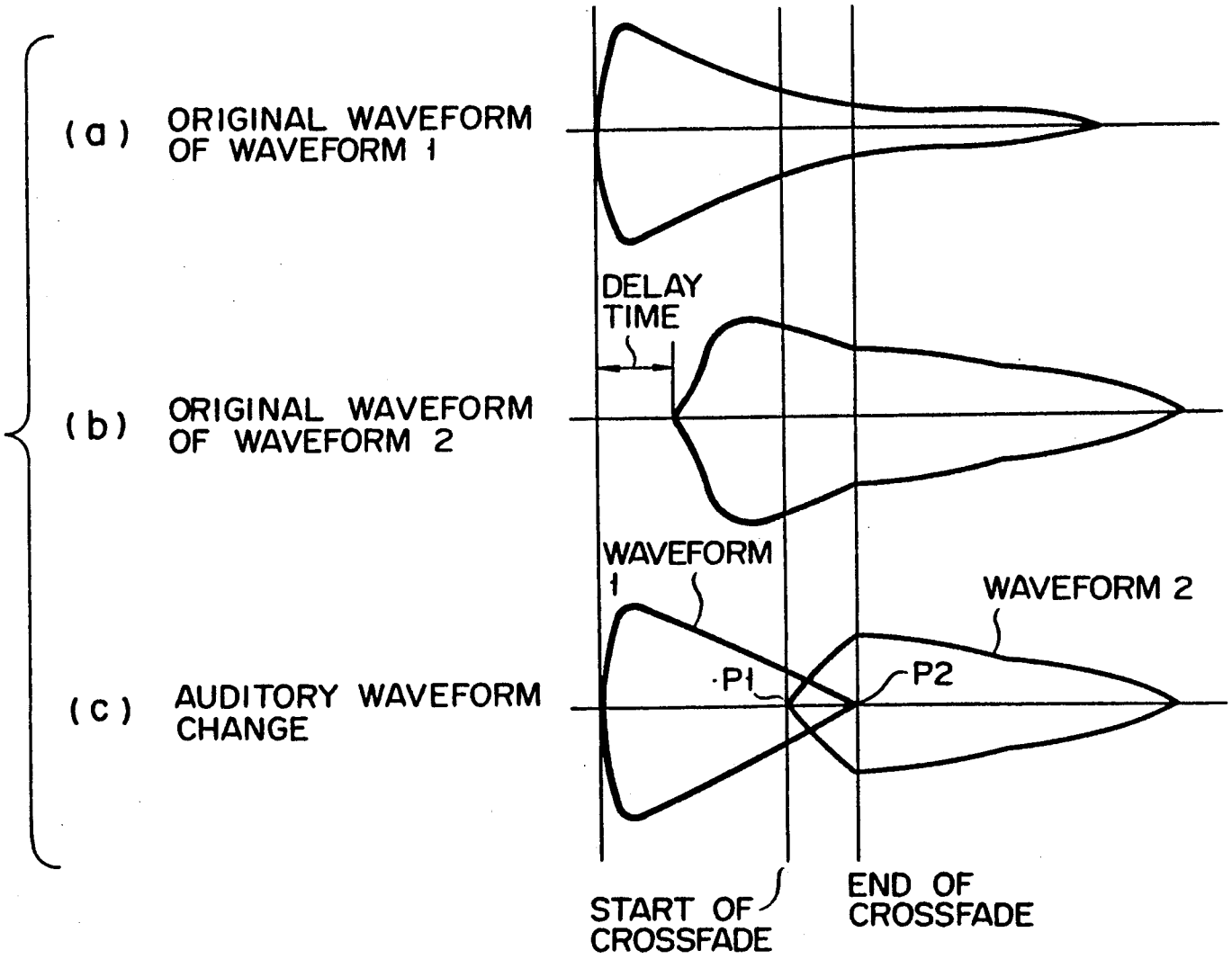
FIG. 18 shows charts showing waveforms when the delay time is not zero.

(A), (B), and (C) in FIG. 18 show waveforms in crossfade synthesis when the delay time is not zero. In other words, the operation of the fourth embodiment is performed. As compared with FIGS. 17, waveform 2 is delayed by a given delay time and is synthesized with waveform 1.

Figure 19:
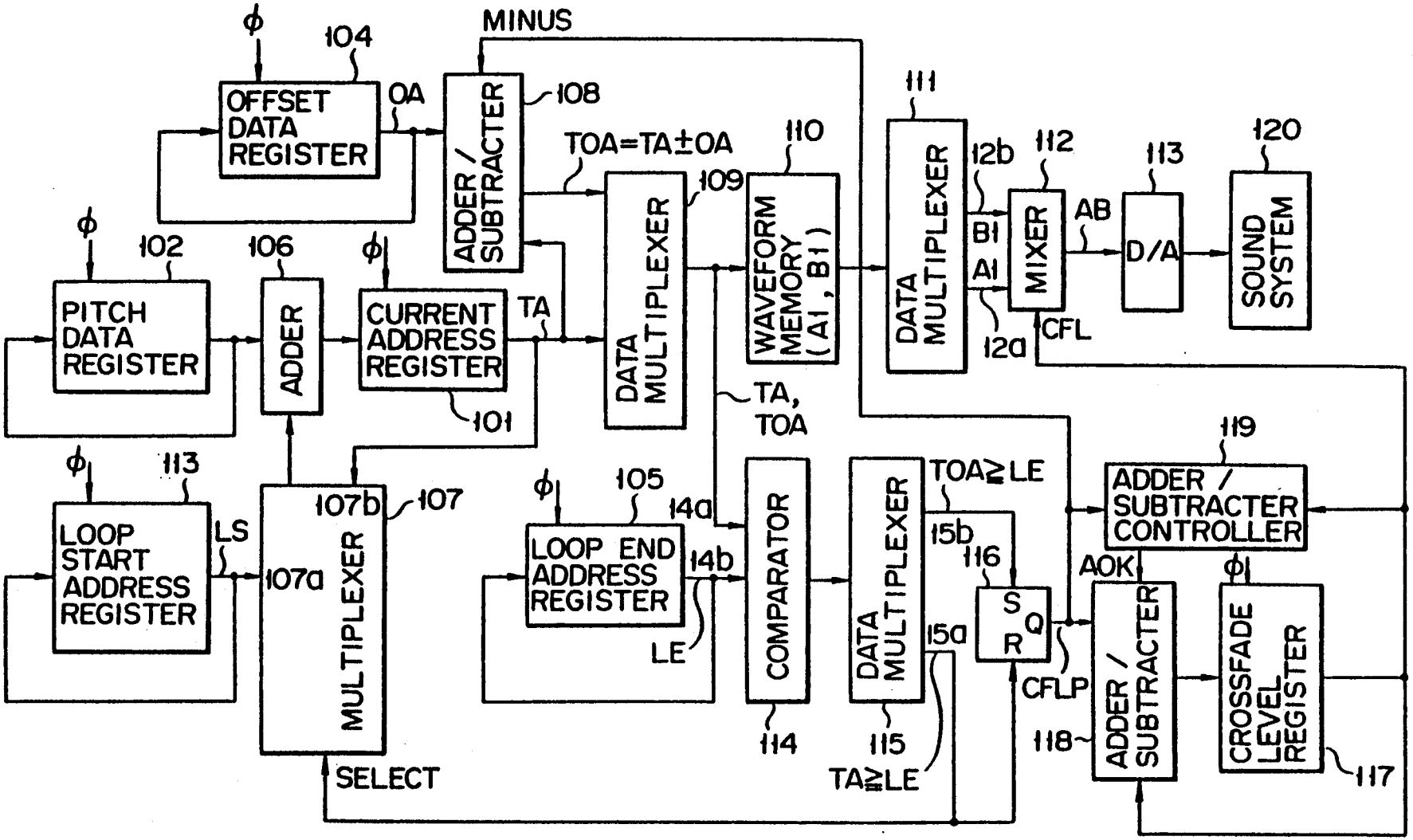
FIG. 19 is a block diagram of an electronic musical instrument employing the present invention according to a fifth embodiment.

FIG. 19 shows the main circuit of an electronic musical instrument according to a fifth embodiment of the present invention. Reference numeral 110 denotes a random access memory (RAM) which serves as a waveform memory for storing waveform data of predetermined musical tones obtained by collecting external sounds with a microphone (not shown) and sampling the external sounds. Waveform data stored in waveform memory 110 is read out by loop reproduction operations in response to key depression operations at a keyboard (not shown), and the readout data is crossfaded. Therefore, a clear and smooth musical tone is produced from sound system 120.

This embodiment exemplifies a polyphonic (8 tones) electronic musical instrument employing time division processing. Current address register 101, pitch data register 102, loop start address register 103, offset data register 104, loop end address register 105, and crossfade level register 117 are constituted by 8-stage registers, respectively. Current address register 101 outputs current address TA of a reproduction loop. Pitch data register 102 outputs pitch data for designating a read speed of waveform in accordance with a pitch designated by any key operation at the keyboard. Loop start address register 103, offset data register 104, and loop end address register 105 receive from a CPU (not shown) loop start address data LS for waveform read access for performing loop reproduction of waveform data stored in waveform memory 110, offset data OA for producing offset address data TOA (second address value) offset from the current address data (first address value) in current address register 101, and loop end address data LE representing the read end address. Data in registers 103, 104, and 105 is looped through corresponding feedback circuits in response to predetermined clock pulses $\phi$.

Adder 106 adds pitch data, from pitch data,, register 102 to an output from multiplexer 107. Current address data TA as an output from register 101 is increased in accordance with the operation mode of adder 106. Similarly, offset data OA is added to or subtracted from current address data TA as the output from current address register 101 by adder/subtracter 108. Offset address data TOA as an output from adder/subtracter 108 is increased or decreased in accordance with the operation mode of adder/subtracter 108.

Current and offset address data TA and TOA as outputs from current address register 101 and adder/-subtracter 108 is input to input terminals 109*a* and 109*b* of data multiplexer 109, respectively. One of the inputs is selected in accordance with the channel timings and the selected data is supplied as read address data to waveform memory 110. The waveform data read out in response to the input address data is demultiplexed by data demultiplexer 111 into two waveform data (Al and B1) corresponding to the current and offset addresses. Waveform data Al and B1 is input to input terminals 112*a* and 112*b* of mixer 112, respectively. Mixer 112 weights waveform data Al and B1 in accordance with crossfade level CFL input to another input terminal 112*c* thereof, thereby outputting crossfaded smooth waveform data AB to D/A converter 113. The waveform data is converted into an analog value by D/A converter 113, and the analog value is produced as a musical tone from sound system 120.

The address data selected by data multiplexer 109 is input to one input terminal 114*a* of comparator 114. Loop end address data LE is input from loop end address register 105 to the other input terminal 114*b* of comparator 114. Since terminal 114*a* alternately receives the two address values as a function of time, comparator 114 performs two types of comparison operations. More specifically, current address data TA is compared with loop end address data LE; and offset address data TOA obtained by adding offset data to or subtracting it from the current address data is compared with loop end address data LE. Comparison result TA≧LE or TOA≧LE (all "1" signals) in comparator 114 is demultiplexed by data demultiplexer 115 synchronized with data multiplexer 109, on the basis of the channel timing, into output terminal 115*a* (TA≧LE) or 115*b* (TOA≧LE).

If the comparison result in comparator 114 is given as TA≧LE, output terminal 115*a* of data demultiplexer 115 is set at logic "1". In this case, S/R flip-flop 116 is reset and at the same time the selection control signal of data multiplexer 107 is inverted. Terminal 107*a* is disconnected from the output terminal of data multiplexer 107 and terminal 107*b* is connected thereto. Loop start address data LS stored in loop start address register 103 is written in current address register 101 through adder 106.

If the comparison result in comparator 114 is set to be TOA≧LE, output terminal 115*b* of data demultiplexer 115 is set at logic "1" so that signal CFLP at output terminal Q of S/R flip-flop 116 is set at logic "1". Signal CFLP supplied to adder/subtracter 118 serves as an addition instruction for Q=1 and a subtraction instruction for Q=0. Crossfade level CFL as an output from crossfade level register 117 is incremented by one for CFLP=1 and decremented by one for CFLP=0. Updated crossfade level CFL is supplied to input terminal 112*c* of mixer 112 as a signal for weighting waveform data read out from waveform memory 110. Crossfade level CFL is also input to adder/subtracter control circuit 119.

Adder/subtracter control circuit 119 serves as a circuit for generating operating signal AOK for setting adder/subtracter 118 in the addition or subtraction state. Signal AOK is output for a period corresponding to a difference between the maximum and minimum values preset in adder/subtracter control circuit 119. In the addition condition for CFLP, i.e., CFLP=1, signal AOK is disabled when crossfade level CFL reaches the maximum value in adder/subtracter control circuit 119. In the subtraction condition for CFLP, i.e., CFLP=0, signal AOK is disabled when crossfade level CFL reaches the minimum value. In this state, adder/subtracter 118 stops an addition or subtraction.

Signal CFLP as an output from S/R flip-flop 116 serves as a subtraction instruction signal MINUS for adder/subtracter 108. Adder/subtracter 108 serves as a subtracter for CFLP=1 and an adder for CLFP=0.

OPERATION OF FIFTH EMBODIMENT

The operation of the fifth embodiment will be described below.

Figure 20:
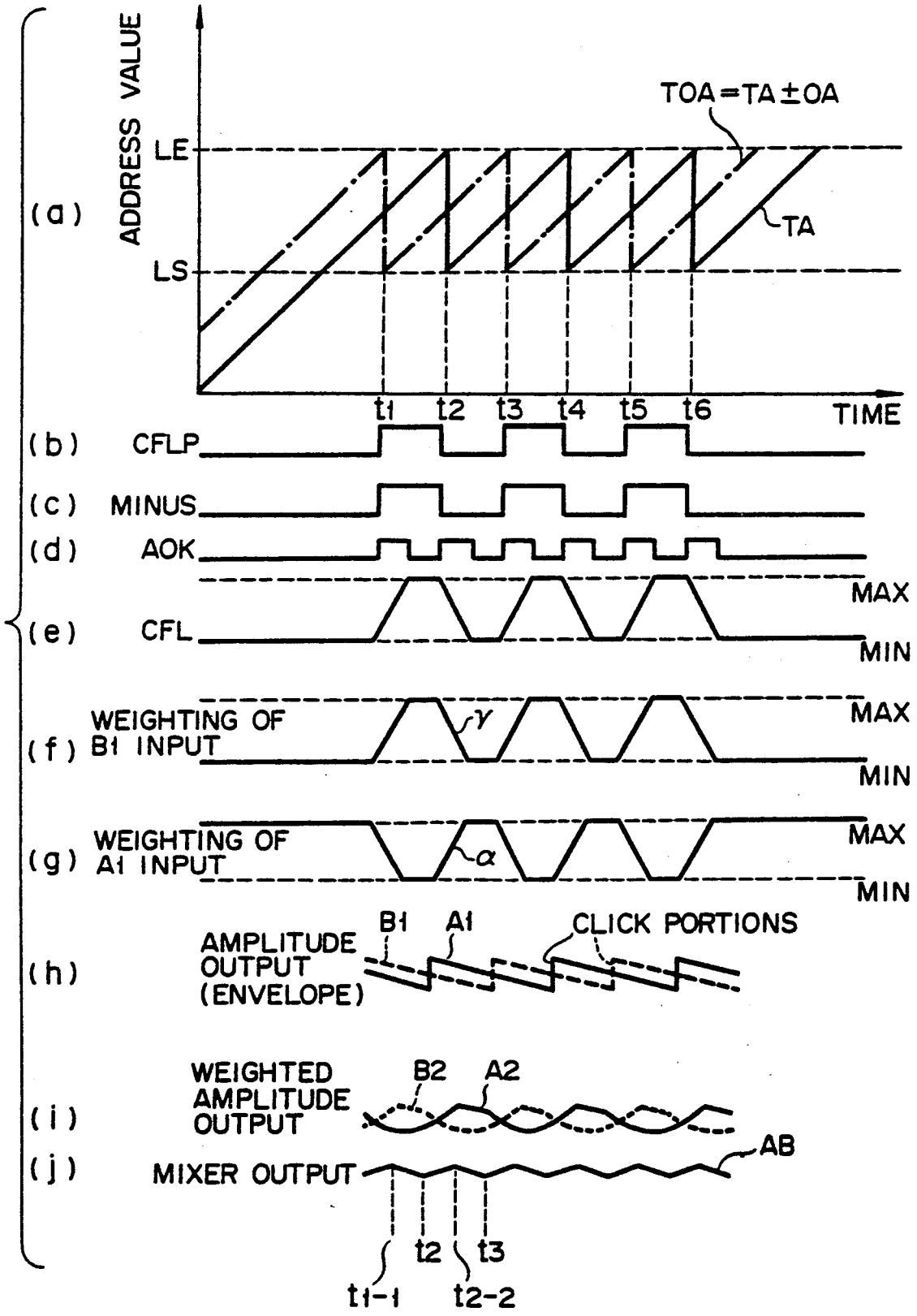
FIG. 20 shows timing charts for explaining the operation of the circuit shown in FIG. 19.

FIG. 20 shows signal waveforms of the circuit components in FIG. 19. Reference numerals and symbols in FIG. 20 correspond to those in FIG. 19.

The gradients of waveforms of current address data TA (indicated by the solid line in (1) in FIG. 20) and offset address data TOA (indicated by the dotted line in (1) in FIG. 20) are determined on the basis of pitch data output from pitch data register 102. The read address data of the waveform data for waveform memory 110 is repeated together with current and offset address data TA and TOA such that loop start address data LS in loop start address register 103 serves as a lower limit and loop end address data LE in loop end address register 105 serves as an upper limit. In this embodiment, offset data OA in offset data register 104 is set to be (LE - LS)/2. Therefore, timing intervals (adjacent intervals defined by t1, t2, . . . t6) at which TA and TOA are started are equal to each other. Output terminals 115*a* and 115*b* of data demultiplexer 115 are alternately set at logic "1" in response to the comparison result from comparator 114 to set S/R flip-flop 116 at times t1, t3, t5, . . . , and to reset S/R flip-flop 116 at times t2, t4, t6, . . . . Output signal CFLP from S/R flip-flop 116 has a waveform shown in (2) in FIG. 20. CFLP=1 represents subtraction instruction signal MINUS (in (3) in FIG. 20) for adder/subtracter 108, and offset address data TOA returns to loop start address LS at timings when CFLP is set at logic "1", i.e., at times t1, t3, t5, . . . . Similarly, the timings corresponding to times t2, t4, t6, . . . when CFLP is set at "0" correspond to timings at which "1" is input to reset terminal R of S/R flip-flop 116. The selection signal in data multiplexer 107 is inverted, and current address data TA returns to loop start address data LS.

CFLP=1 serves as an addition instruction for adder/subtracter 118. Crossfade level CFL as an output from crossfade level register 117 is fed back and incremented one by one through adder/subtracter 118 from, e.g., time t1, as shown in (5) in FIG. 20. When crossfade level CFL reaches maximum value MAX, adder/subtracter control circuit 119 stops outputting operating signal AOK to stop addition/subtraction. Crossfade level CFL is maintained at maximum value MAX. Operating signal AOK from adder/subtracter control circuit 119 is enabled again at time t2 when CFLP is set at logic "0". Crossfade level CFL in crossfade level register 117 is fed back and decremented one by one through adder/subtracter 118. When crossfade level CFL reaches minimum value MIN in adder/subtracter control circuit 119, signal AOK is disabled to stop operating adder/subtracter 118. Thereafter, until CFLP is updated to logic "1", crossfade level CFL in crossfade level register 117 is maintained to be minimum value MIN. The waveform of operating signal AOK output from adder/subtracter control circuit 119 is shown in (4) in FIG. 20. AOK is enabled and disabled once during each time interval, e.g., a duration between time t1 and time t2.

The output from crossfade level register 117, i.e., crossfade level CFL is supplied to input terminal 112*c* of mixer 112 and is used to crossfade waveform data Al and B1 (in (8) in FIG. 20) respectively input to terminals 112*a* and 112*b*.

Curve Al indicated by the solid line in FIG. 20(8) represents an envelope, i.e., an amplitude of waveform data read out from waveform memory 110 in response to current address data TA. Curve B1 represents an amplitude value corresponding to offset address data TOA. Amplitude value B1 is weighted with signal $\gamma$ (in (6) in FIG. 20) having the same waveform as that of crossfade level CFL. Amplitude value Al is weighted with signal $\alpha$ (in (7) in FIG. 20) having a waveform obtained by inverting that of CFL. As a result, two waveforms B2 and A2 shown in (9) in FIG. 20 are obtained. Weighting is performed by multiplying $\gamma$ with amplitude value B1 (in (8) in FIG. 20) and $\alpha$ with Al (in (8) in FIG. 20).

Curve AB shown in (10) in FIG. 20 represents an output from mixer 112 and is obtained by mixing two weighted waveforms A2 and B2 shown in (9) in FIG. 20. As is apparent from the timing chart, a smooth musical tone waveform free from click portions near a crossing point between the end and start addresses in the loop interval can be obtained. Waveform B2 (in (9) in FIG. 20) is output for a duration between time t1-1 when operating signal AOK from adder/subtracter control circuit 119 is set at logic "0" and time t2. However, waveform A2 is output for a duration between time t2-2 when AOK is set at logic "0" next and time t3. For a connecting duration between these waveforms, i.e., between time t2 and time t2-2, a synthesizing waveform having a decreasing portion of waveform B and an increasing portion of waveform A appears. As a result, a gradually ascending waveform can be obtained.

As described above, in this embodiment, the waveforms can be repeatedly read out on the basis of loop start address data preset in loop start address register 103 and loop end address data preset in loop end address register 105 under the control of the CPU. In addition, two waveform data loop-reproduced at opposite phases are weighted in opposite directions, and the weighted data are synthesized (mixed), thereby performing crossfade processing. Even if click portions are present by looping the original waveform, noise such as click sounds are not included in the reproduced tone, thereby obtaining a comfortable clear musical tone.

Loop start address register 103 and loop end address register 105 can be rewritten by the CPU. During the progress of read access of the waveforms, when the player inputs predetermined loop start and end address data respectively in loop start address register 103 and loop end address register 105, a plurality of loop reproduction operations can be automatically performed.

A sixth embodiment exemplifies an improvement of the fifth embodiment. A switching means and a display means are arranged to simplify setting of a plurality of loop intervals and setting of the read sequence in the loop interval. In addition, the player can arbitrarily set an interval in which the crossfade operation is performed.

Figure 21:
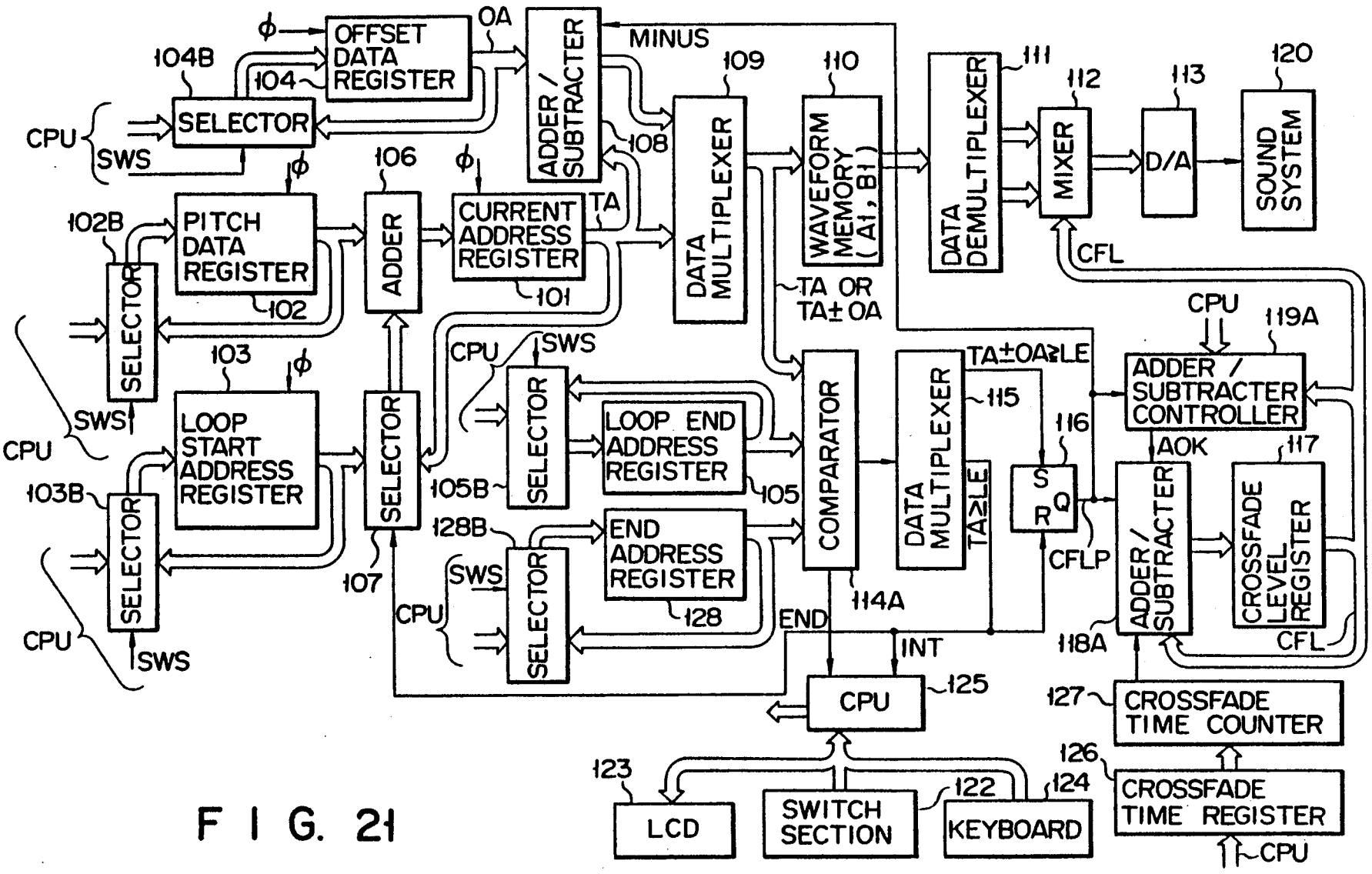
FIG. 21 is a block diagram of an electronic musical instrument according to a sixth embodiment of the present invention.

FIG. 21 is a block diagram showing the main part of an electronic musical instrument according to the sixth embodiment. The basic arrangement of the circuit in FIG. 21 is the same as that in FIG. 19. The same reference numerals and letters as in FIG. 19 denote the same parts and letters in FIG. 21, and a detailed description thereof will be omitted. Parts of FIG. 21 which are different from those of FIG. 19 will be described.

The electronic musical instrument of this embodiment includes switch section 122 for inputting crossfade parameters and display section (LCD) 123 for displaying parameters input at switch section 122. CPU 125 receives outputs from switch section 122 and keyboard 124 including a plurality of keys and decodes the input data in a predetermined data format. The decoded data are stored in the corresponding internal registers. The stored data is output to circuit components as needed. A preset value for changing the crossfade interval output from CPU 125 is input to crossfade time counter 127 through crossfade time register 126. End address register 128 is arranged to supply an end address of the entire waveform to comparator 114A. The END (end) signal from comparator 114A and the INT (interrupt) signal from data demultiplexer 115 are input to CPU 125. An output from crossfade time counter 127 is connected to the +1 terminal of adder/subtracter 118A to control the increase rate of crossfade level CFL. Selectors 102B, 103B, 104B, 105B, and 128B are connected to feedback circuits for registers, respectively, i.e., pitch data register 102, loop start address register 103, offset data register 104, loop end address register 105, and end address register 128. These selectors are operated to select the corresponding data for the corresponding register or data from CPU 125.

Figure 22:
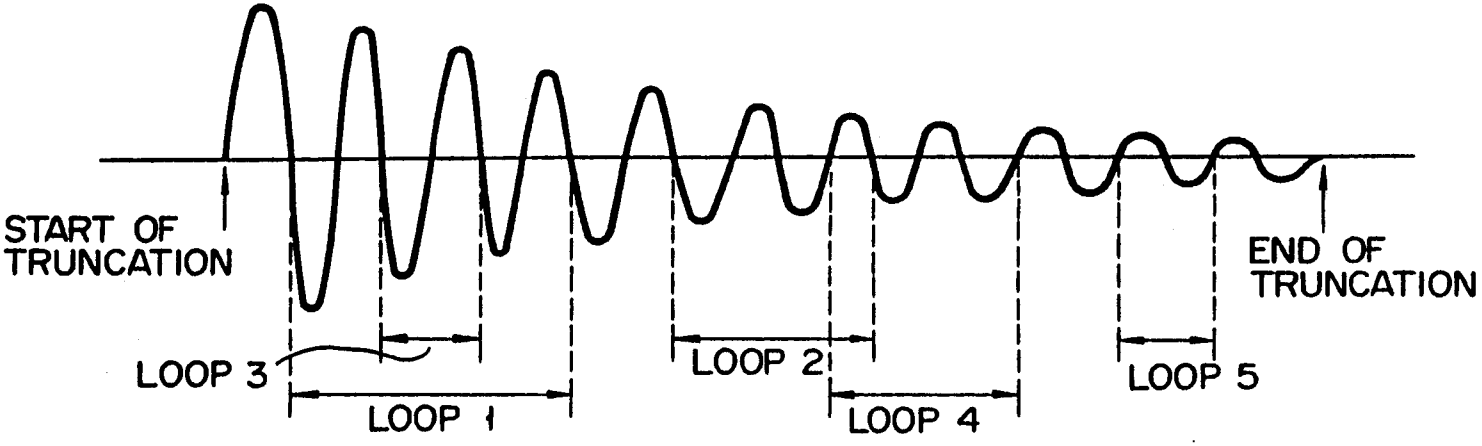
FIG. 22 is a chart showing a multiloop setting state.

The INT signal from data demultiplexer 115 is output when data TA in current address register 101 represents a loop end. The INT signal is synchronized with the transfer timing of start address data stored in loop start address register 103 and transferred to current address register 101 through data multiplexer 115. The INT signal serves as an interrupt signal to CPU 125. In the sixth embodiment, arbitrary portions of one waveform designated by the start of truncation to the end thereof are extracted as loop 1, loop 2, loop 3, loop 4, and loop 5, as shown in FIG. 22. Therefore, the INT signal is used as an interrupt signal for shifting one loop to another loop.

The END signal from comparator 114A is output at the read end of the entire waveform so as to correspond to the contents of end address register 128. CPU 125 responds to the END signal and waveform generation is terminated.

Signal +1 output from crossfade time counter 127 is an increment signal for adder/subtracter 118A. The increment signal serves as a carry signal output every variable time interval when viewed from crossfade time counter 127 since the counting rate of crossfade time counter 127 is changed by a preset value supplied from CPU 125 to crossfade time register 126. However, when viewed from adder/subtracter 118A, the increment signal serves as an operation instruction signal. When a signal is input to adder/subtracter 118A, the contents of crossfade level register 117 are incremented by one. Otherwise, the contents of crossfade level register 117 are fed back without incrementation/decrementation.

Figure 23:
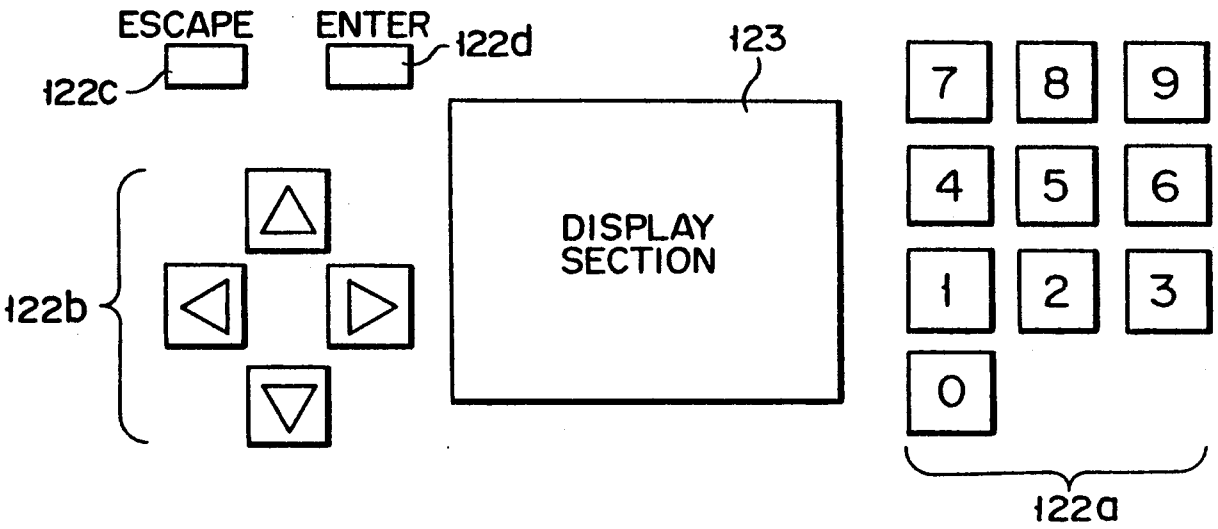
FIG. 23 is a schematic view showing the panel surface layout of a switch section and a display section (LCD)

FIG. 23 shows the layout of an operation panel surface. LCD 123 is located at the center of the operation panel surface. Ten-key pad 122*a* for inputting a numeric value in switch section 122 is arranged to the right of LCD 123. Four cursor shift keys 122*b*, escape key 122*c* and enter key 122*d* are arranged to the left of LCD 123. Cursor shift keys 122*b* are used to shift function designation arrow 123*a* (FIG. 24) and cursor 123*b* (FIG. 25) in one of the upper, lower, right, and left directions. Escape key 122*c* is used to display the immediately preceding mode. Enter key 122*d* is used to confirm the type of displayed mode and the input value.

Procedures for setting a multiloop shown in FIG. 22 by using switch section 122 and LCD 123 will be described mainly with reference to FIGS. 23 to 27.

Figure 24:
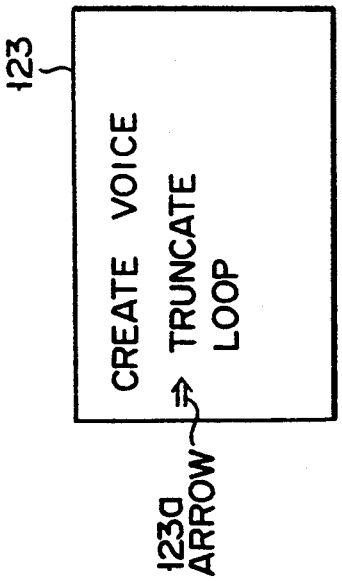
FIG. 24 is a view showing a main menu.

FIG. 24 shows contents of the main menu in which musical tone generation (CREATE VOICE) mode is displayed with predetermined operations. The player shifts arrow 123*a* with cursor shift keys 122*b* to truncation position (TRUNCATE) and depresses enter key 122*d* to designate the type of generation mode.

Figure 25:
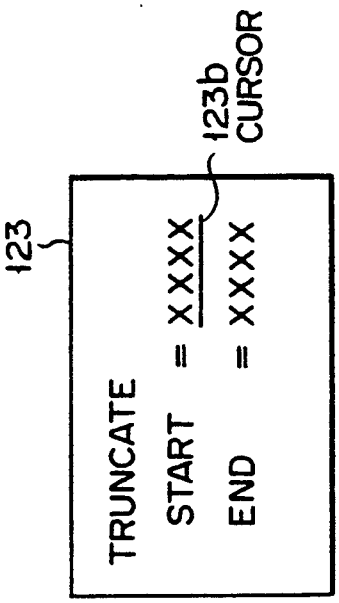
FIG. 25 is a view showing a truncation (TRUNCATE) menu.

As shown in FIG. 25, LCD 123 displays the truncate menu (TRUNCATE). The player shifts cursor 123*b* with cursor shift keys 122*b* to the start position (START) and enters a truncation start address representing the start of the necessary waveform (FIG. 22). Thereafter, the player depresses enter key 122*d*, thereby setting the truncation end address (END) representing the end of tone generation with the same operations as described above, and hence determining the range of waveform. When the player then operates escape key 122*c*, LCD 123 displays the immediately preceding display contents of FIG. 24. The player sets arrow 123*a* to the loop position (LOOP) and depresses enter key 122*d*.

Figure 26:
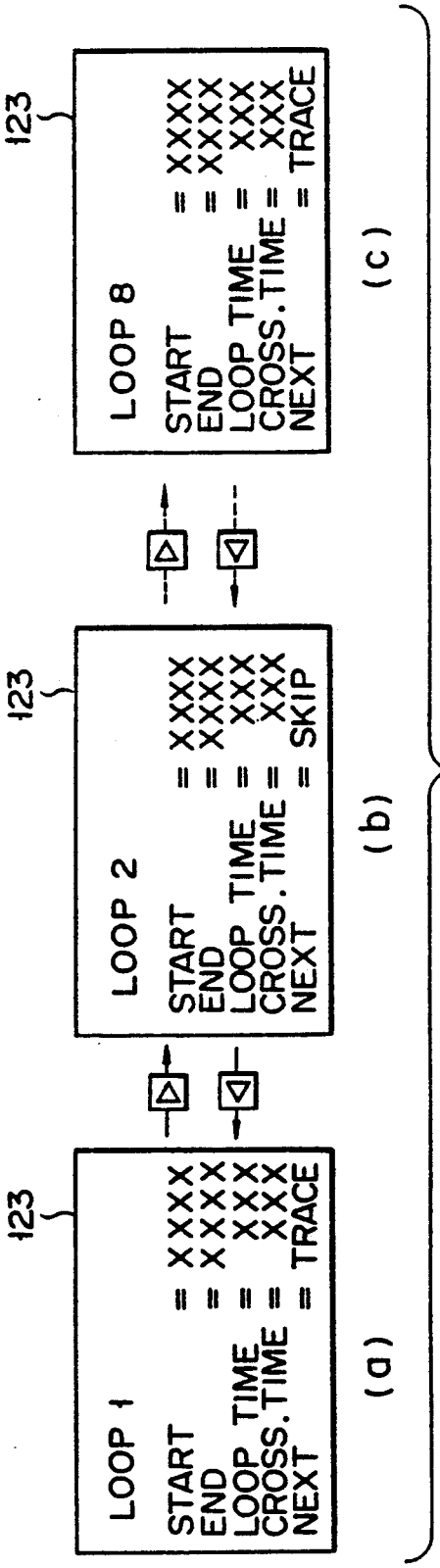
FIG. 26 shows views showing the loop menu.

The display contents of LCD 123 are changed to loop menu 1 (LOOP 1) shown in FIG. 26(*a*). In the same manner as described above, cursor shift keys 122*b* are operated to shift cursor 123*b* in position and a desired value is input with ten-key pad 122*a*. When the player depresses enter key 122*d*, loop 1 is confirmed. In this state, various parameters of loop 1 are set. The start (START) and the end (END) are start and end address data of loop 1. A loop time (LOOP TIME) is the repetition time of loop 1. A crossfade time (CROSS TIME) is a time required for crossing two waveforms. The next (NEXT) designates that all loop intervals are sequentially performed, i.e., they are traced (TRACE) or some loop intervals are skipped (SKIP) when the current loop is changed to the next loop (in this case loop 2). The designation of the NEXT can also be performed by using lower cursor shift key "▽" 122*b* and is confirmed with enter key 122*d*. In this state, when right cursor shift key "√D" is depressed, the display contents of LCD 123 are updated to loop menu 2 (LOOP 2), as shown in (b) in FIG. 26.

The menu contents of loop 2 to loop 8 are the same a those of loop 1 and can be set in the same manner as described above. The number of loops to be used can be arbitrarily set. If the player wishes to use five loops, as shown in FIG. 22, he can use loop 1 to loop 5. In order to display the previous display contents, e.g., from loop 2 to loop 1, the player depresses left cursor shift key "S".

Figure 27:
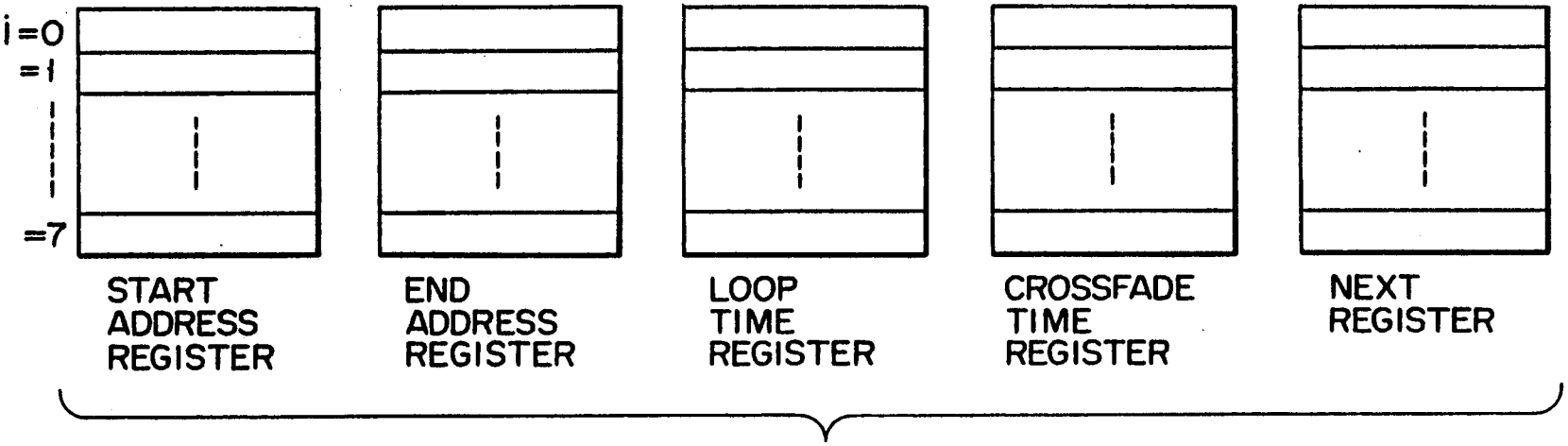
FIG. 27 is a view showing main registers.

The preset values for each loop are sequentially set in the corresponding registers, as shown in FIG. 27. If unused loops are present, the end address data set in the truncation mode is stored in the corresponding start and end address registers as initial values, and "0" is stored in the loop and cross time registers as the initial value. TRACE is set in the next register as the initial value.

OPERATION OF SIXTH EMBODIMENT

The operation of the sixth embodiment will be described below.

Figure 28:
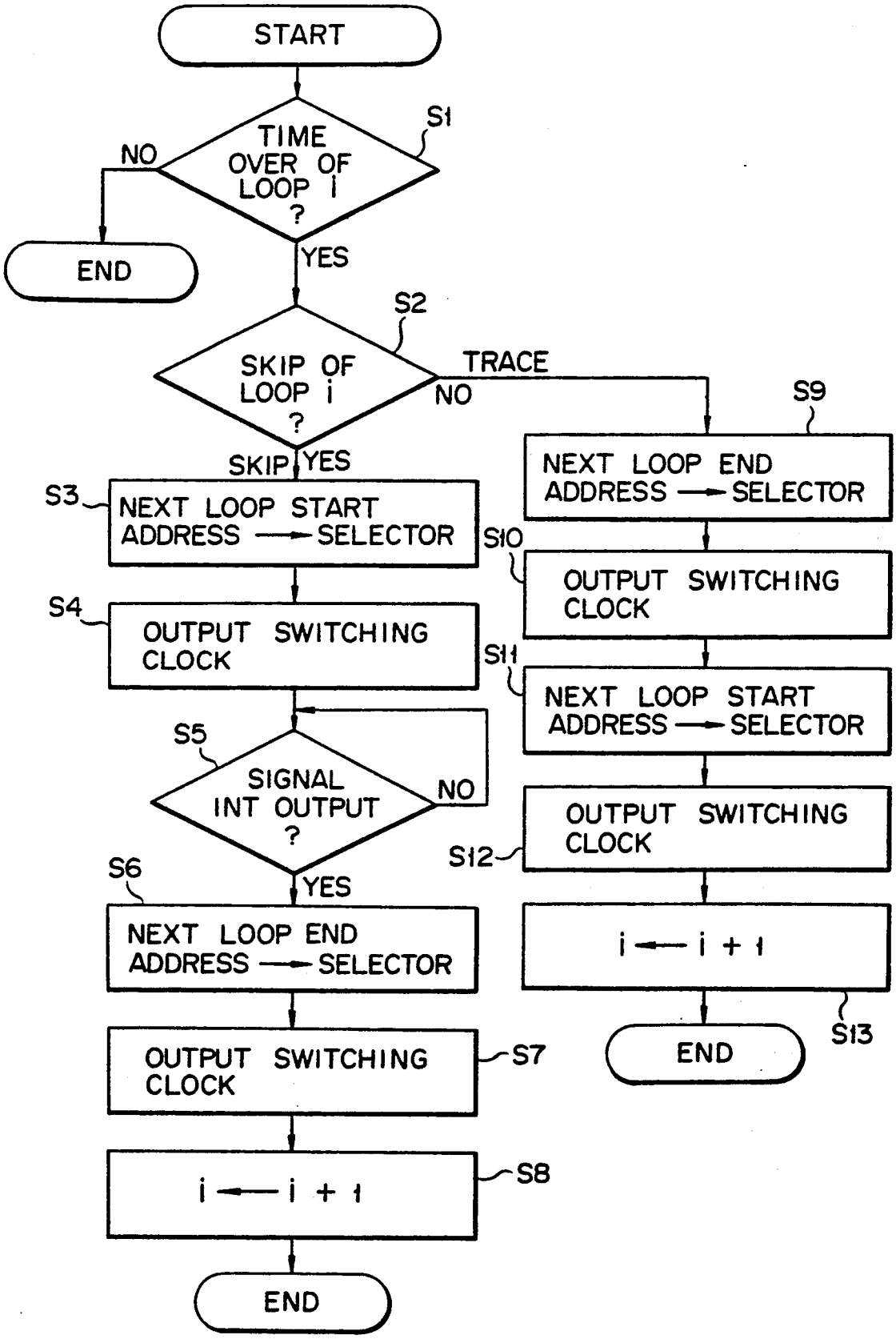
FIG. 28 is a flow chart for explaining the multiloop operation.

FIG. 28 is a flow chart for explaining the multiloop operation. This flow chart is started in response to the INT signal from the data demultiplexer 115 while keyboard 124 is set in the key ON state. CPU 125 determines in step S1 whether the first loop end appears after the loop time end of loop i (the ith loop). If YES in step S1, the flow advances to step S2. CPU 125 determines in step S2 whether the NEXT contents in this loop represent the SKIP.

Figure 29:
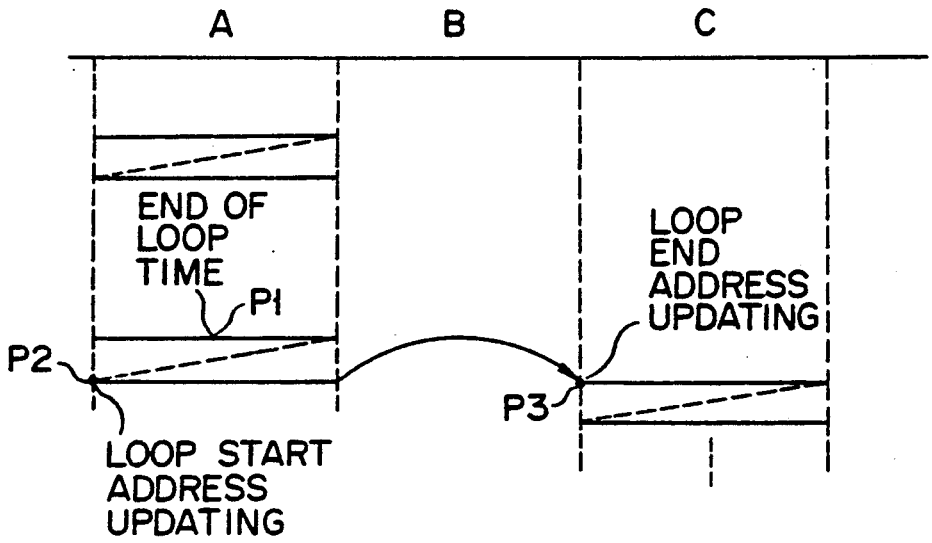
FIG. 29 is a chart for explaining the skip operation

If YES in step S2, CPU 125 supplies the start address data of the next loop to selector 103B of loop start address register 103. Subsequently, switching signal SWS is supplied to selector 103B (step S4), and CPU 125 waits for the next INT signal output (step S5). When the next INT signal is output, the end address data of the next loop is supplied to selector 105B of loop end address register 105 (step S6) and switching signal SWS is supplied thereto step S7). The count of loop number register i is incremented by one (step S8), and the flow is ended. FIG. 29 illustrates timings of skip processing in steps S3 to S7. Assume that the loop time end during interval A (corresponding to the loop) occurs in intermediate point Pl in this interval. When the loop end of interval A passes and the address returns to the start address, CPU 125 switches the loop start address data of loop start address register 103 at point P2 into loop start address data in interval C (steps S3 and S4). The address data represents a value larger than that of the loop end address in interval A (step S5), and interval B is skipped. When the address data represents a value equal to that of point P3 in interval C, CPU 125 switches the loop end address data of loop end address register 105 into loop end address data of interval C. The counts of the registers shown in FIG. 27 are incremented by one each to designate the next register contents, thereby incrementing loop number register i by one (step S8).

Figure 30:
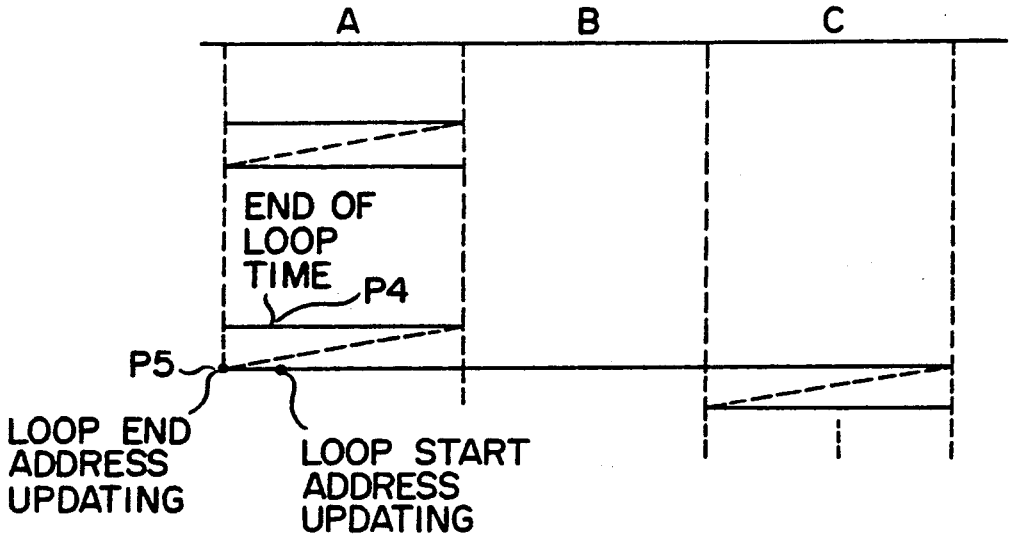
FIG. 30 is a chart for explaining the trace operation.

Referring back to FIG. 28, if NO in step S2, the TRACE is determined to be designated. CPU 125 supplies the end address data of the next loop to selector 105B of loop end address register 105 in step S9, and switching signal SWS is input thereto (step S10). Subsequently, CPU 125 supplies start address data of the next loop to selector 103B of loop start address register 103 (step S11), and switching signal SWS is supplied thereto (step S12). The count of loop number register i is incremented by one (step S13), and the flow is ended. FIG. 30 illustrates the timings of trace processing in steps S9 to S12. Assume that the loop time end in interval A occurs at intermediate point P4 in this interval. CPU 125 switches the loop end address data of loop end address register 105 into loop end address data of interval C at point P5 where the loop end address in interval A is returned to the start address (steps S9 and S10). Subsequently, the loop start address data of loop start address register 103 is switched to the loop start address data of interval C (steps S11 and S12).

Skip and trace processing between the loops can be performed as described above.

Figure 31:
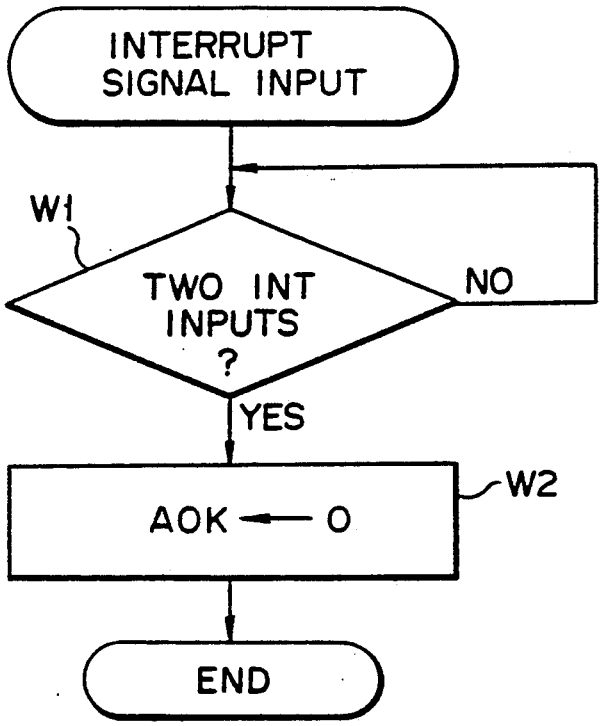
FIG. 31 is a flow chart for explaining the operation of an adder/subtracter controller.

FIG. 31 is a flow chart showing an operation flow of adder/subtracter controller 119A. This flow is initiated at the loop time end. CPU 125 determines in step W1 whether two INT signals are generated. If YES in step W1, the flow advances to step W2. In step W2, output AOK for adder/subtracter 118A is set to "0", and the flow is ended. The operations in steps W1 and W2 are performed as follows. When one loop time has elapsed, the mixing ratio of the major waveform corresponding to output TA from current address register 101 is preferably a maximum value. Timing control is performed such that crossfade level CFL as an output from crossfade level register 117 is gradually increased to a maximum value (step W1). At this timing, signal AOK input to adder/subtracter 118A is set at logic "0" to inhibit operation thereof, and the crossfade level of crossfade level register 117 is maintained to be a maximum level (step W2), thereby preventing generation of click noise.

Figure 32:
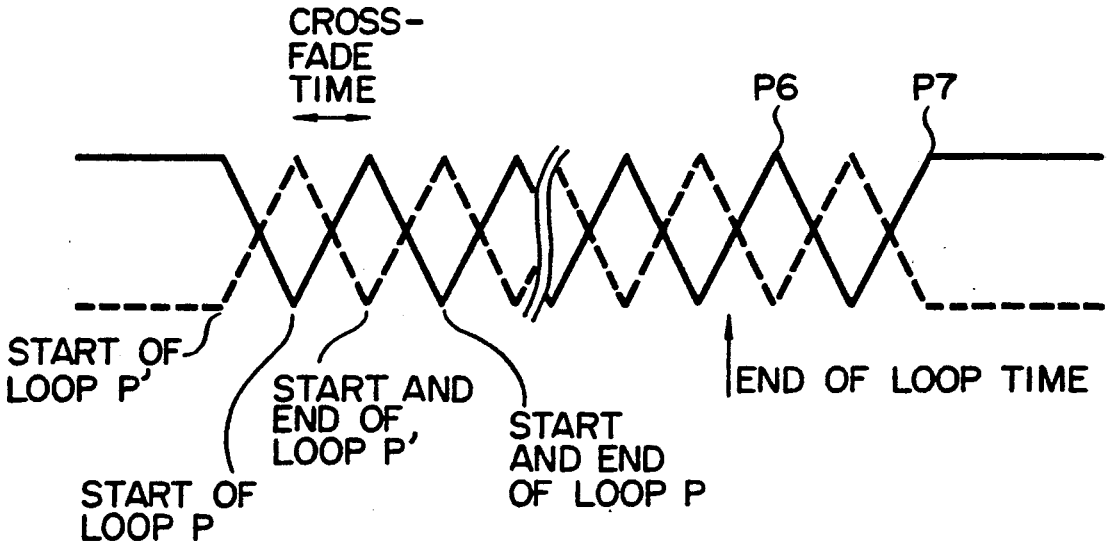
FIG. 32 is a chart showing crossfade levels.

FIG. 32 shows crossfade level CFL as an output from crossfade level register 117, wherein crossfade time is set to be half the loop interval. In other words, by adjusting the CROSS TIME in FIG. 26, the crossfade level is immediately decreased as soon as it reaches the maximum value preset in adder/subtracter controller 119A. This indicates an optimal crossfade condition. The crossfade level corresponding to the major waveform in current address register 101, as described with reference to the flow of FIG. 31 is indicated by the solid line. In order to gradually increase the crossfade level and maintain it to be a minimum value after the loop time end, two maximum values, i.e., two INT signals must be output from data demultiplexer 115 at points P6 and P7.

For example, a possibility for generating click noise caused by generation of loop time end at the second half of one loop and an abrupt increase in crossfade level to the maximum value (100%) can be prevented.

In the sixth embodiment, the waveform data between the succeeding loops is read out without modifications or is kept stored. Therefore, a variety of sound source waveforms can be obtained. In addition, the crossfade intervals can be arbitrarily set, so that the waveform memory can be effectively utilized.

What is claimed is:

1. A waveform synthesizing apparatus comprising:
memory means for storing digital waveform signals;
designating means for designating at least two of said digital waveform signals to be read out from said memory means;
display means for displaying lengths of said at least two digital waveform signals designated by said designating means;
rate data memory means for storing rate data set in accordance with the lengths of said at least two digital waveform signals displayed by said display means;
reading means for reading said at least two digital waveform signals designated by said designating means at a reading rate corresponding to the rate data stored in said rate data storing means;
synthesizing output means for synthesizing said at least two digital waveform signals read out from said reading means and outputting a synthesized digital waveform signal; and
writing means for writing the synthesized waveform signal output from said synthesizing output means into said memory means.

2. A waveform synthesizing apparatus according to claim 1, further comprising means for varying a synthesis ratio of said at least two digital waveform signals read out from said reading means as time elapses.

3. A waveform synthesizing apparatus comprising:
memory means for storing digital waveform signals;
designating means for designating at least two of said digital waveform signals to be read out from said memory means;
part designating means for designating part of each of said at least two digital waveform signals designated by said designating means;
reading means for reading said at least two digital waveform signals designated by said designating means;
synthesizing output means for synthesizing said at least two digital waveform signals read out from said reading means, starting from the part designated by said part designating means, and outputting a synthesized digital waveform signal; and
writing means for writing the synthesized digital waveform signal output from said synthesizing output means into said memory means.

4. A waveform synthesizing apparatus according to claim 3, further comprising means for varying a synthesis ratio of said at least two digital waveform signals read out from said reading means as time elapses.

5. A waveform synthesizing apparatus comprising:
memory means for storing digital waveform signals;
designating means for designating at least two of said digital waveform signals to be read out from said memory means;
reading means for reading said at least two digital waveform signals designated by said designating means;
connecting output means for connecting said at least two digital waveform signals read out from said reading means and outputting a connected digital waveform signal; and
writing means for writing the connected digital waveform signal into said memory means.

6. A waveform synthesizing apparatus according to claim 5, wherein said connecting output means synthesizes and connects said at least two digital waveform signals while varying a synthesis ratio of said at least two digital waveform signals read out from said reading means as time elapses.

7. A waveform synthesizing apparatus according to claim 6, wherein said connecting output means comprises interval designating means for designating an interval in which said at least two digital waveform signals are synthesized, while varying a synthesis ratio of said at least two digital waveform signals read out from said reading means as time elapses.

8. An electronic musical instrument comprising:
memory means for storing digital waveform signals;
designating means for designating a plurality of loop intervals of the digital waveform signals stored in said memory means; and
output means for repeatedly reading the digital waveform signals in said plurality of loop intervals designated by said designating means from said memory means and outputting tone waveform signals.

9. An electronic musical instrument according to claim 8, wherein said output means comprises second output means for selectively reading the digital waveform signals between the loop intervals designated by said designating means from said memory means and outputting tone waveform signals.

10. An electronic musical instrument according to claim 9, wherein said second output means comprises second designating means for designating whether the digital waveform signals between the loop intervals designated by said designating means are read out.

11. An electronic musical instrument according to claim 8, wherein said designating means comprises second designating means for designating loop time for each of said plurality of loop intervals, and said output means repeatedly reads the digital waveform signals between said plurality of loop intervals for a period of the loop time designated by said second designating means and outputs tone waveform signals.

* * * * *